US007972085B2

(12) United States Patent
Hess

(10) Patent No.: US 7,972,085 B2
(45) Date of Patent: Jul. 5, 2011

(54) METHOD AND DEVICE FOR SHORING TRENCHES

(76) Inventor: Wilhelm Hess, Lindlar (DE)

( * ) Notice: Subject to any disclaimer, the term of this patent is extended or adjusted under 35 U.S.C. 154(b) by 87 days.

(21) Appl. No.: 12/226,644

(22) PCT Filed: Apr. 25, 2007

(86) PCT No.: PCT/EP2007/054074

§ 371 (c)(1),
(2), (4) Date: Oct. 23, 2008

(87) PCT Pub. No.: WO2007/122255

PCT Pub. Date: Nov. 1, 2007

(65) Prior Publication Data

US 2009/0110490 A1 Apr. 30, 2009

(30) Foreign Application Priority Data

Apr. 26, 2006 (DE) ..... 10 2006 019 236
Dec. 15, 2006 (EP) ..... 06126198

(51) Int. Cl.
*E02D 17/08* (2006.01)

(52) U.S. Cl. ..... 405/282

(58) Field of Classification Search ..... 405/282, 405/283, 272, 274
See application file for complete search history.

(56) References Cited

U.S. PATENT DOCUMENTS 3,224,201 A * 12/1965 Brunton ..... 405/282
3,295,330 A * 1/1967 Meshorer ..... 405/282
3,470,699 A * 10/1969 Cox ..... 405/282
3,766,740 A * 10/1973 Teegen ..... 405/282
3,910,053 A 10/1975 Krings
3,950,952 A * 4/1976 Krings ..... 405/282
4,154,062 A 5/1979 Koehl
4,657,442 A * 4/1987 Krings ..... 405/282
5,310,289 A * 5/1994 Hess ..... 405/282
5,310,290 A * 5/1994 Spencer ..... 405/283
5,503,504 A 4/1996 Hess et al.
5,720,580 A 2/1998 Ryhsen
5,931,607 A * 8/1999 Hess ..... 405/282
6,164,874 A * 12/2000 May ..... 405/283
6,224,296 B1 * 5/2001 Fukumori ..... 405/282
6,848,865 B2 * 2/2005 Kadiu ..... 405/272
7,048,471 B2 * 5/2006 Kadiu ..... 405/282
(Continued)

FOREIGN PATENT DOCUMENTS

DE 2302053 7/1974
(Continued)

*Primary Examiner* — Frederick L Lagman
(74) *Attorney, Agent, or Firm* — Muirhead and Saturnelli, LLC

(57) ABSTRACT

A method and device for shoring trenches includes insertion of a first couple of lining plates into a ditch. A stiff bracing frame may be guided within a first couple of linear guides between the two lining plates, one linear guide being connected to one lining plate. A second couple of lining plates may be guided between the first lining plates and inserted into the ditch. A second couple of linear guides may be inserted between the first linear guides, one of the second linear guides being connected to one of the second lining plates, and the second linear guides being kept at a distance using a brace. The bracing frame between the first linear guides may be removed, and the second lining plates and the second linear guides may be lowered while the stiff bracing frame is inserted between the first linear guides when the ditch is dug deeper.

15 Claims, 22 Drawing Sheets

U.S. PATENT DOCUMENTS 7,258,511 B1 * 8/2007 Cerda et al. ..... 405/282

FOREIGN PATENT DOCUMENTS

| | | | |
|---|---|---|---|
| DE | 2654229 | | 6/1977 |
| DE | 3243122 | A1 | 5/1984 |
| DE | 4226405 | A1 | 2/1994 |
| DE | 4322336 | C2 | 1/1995 |
| EP | 0100083 | A1 | 2/1984 |
| EP | 0475382 | B1 | 3/1992 |
| EP | 0678629 | A1 | 10/1995 |
| EP | 0866175 | A1 | 9/1998 |
| FR | 2222867 | | 10/1974 |

* cited by examiner

METHOD AND DEVICE FOR SHORING TRENCHES

FIELD OF THE INVENTION

This application concerns a method and a device for ditch and trench shoring, in particular for shoring deep trenches.

It concerns in particular a method of trench shoring in which a trench is dug and a shoring device is inserted into the trench, wherein

- at least a first pair of mutually oppositely arranged shoring panels is inserted into the trench,
- at least a first stiff spreading frame is guided displaceably between the two shoring panels in a first pair of linear guides, wherein a respective linear guide of the first pair of linear guides is connected to a respective one of the shoring panels of the first pair of shoring panels, and
- at least a second pair of mutually oppositely arranged shoring panels is guided through between the first pair of shoring panels and inserted into the trench.

In a first configuration of such shoring devices the vertically extending linear guides for the spreading frame are arranged on supports which are disposed in mutually opposite paired relationship and which are inserted into the trench. One or more spreading frames run between the two supports of a pair of supports. Shoring panels or plates are fixed on each side of the trench between two successive supports or struts. In practice, on each side of the trench, the first vertical edge of a shoring panel is held by a front support and the second vertical edge of the shoring panel is held by a rear support.

This application further concerns devices for carrying out that method.

BACKGROUND OF THE INVENTION

EP 0 475 382 A1 to the present applicant discloses such a method using shoring devices with supports. Here, there is proposed a method of lining or shoring deep trenches by means of support frames which can be set up at equal spacings in the longitudinal direction of the trench. The support frames are composed of two parallel supports and a flexurally stiff spreading frame which connects the supports and holds them at a spacing and which is displaceable along the supports. In that document the spreading frames are referred to as 'stiffening frames'. Each support frame forms a support structure which is particularly advantageous in terms of handling in installation and removal. Large-area shoring panels or plates are guided displaceably in receiving passages disposed at both sides of the supports, wherein the shoring panels can be introduced with their lateral edges. The support frames and the shoring panels are pushed or lowered into the trench alternately as the trench is dug out.

In that case the spreading frame is preferably guided on the supports displaceably between a lower abutment and an upper abutment, wherein the lower abutment is arranged at least at the height of the necessary excavator bucket freedom of between about 1 and 1.50 m from the support base and the upper abutment is arranged at a spacing from the lower abutment, which corresponds to the height of the spreading frame, for example 1.75 m, and a permissible support advance, for example 0.5 m. After the support frame has been set up and lowered to a level at which the upper edge of the spreading frame is at the height of the edge of the trench the upper abutments can be removed and a second spreading frame inserted into the supports of the support frame. The upper abutments can then be fixed to the supports at a spacing above that second spreading frame. Optionally, a third flexurally stiff support frame can also be introduced into the supports of the spreading frame. The spreading frames can be connected together for the retreat movement of the support frame.

Those shoring devices have proven their worth in particular for shoring trenches of a great depth of 8 m and more. In comparison with the prior spreading struts which were connected pivotably between the supports of a support frame, the use of a flexurally stiff spreading frame has the crucial advantage that the points of force transfer from the supports to the spreading frames upon a relative movement of the two supports of the pair of supports relative to each other remain within a perpendicular plane extending in the longitudinal direction of the trench. The supports are consequently displaceable relative to each other and relative to the spreading frame in a vertical plane. The shoring panels, the edges of which are guided in vertical receiving passages in the supports also remain in a vertical plane extending in the longitudinal direction of the trench, upon relative movements of the components of the shoring device relative to each other. Thus, when relative movements occur, there is no displacement of the supports or the shoring panels transversely with respect to the longitudinal direction of the trench. Such transverse movements are highly detrimental as they lead to an increased application of force upon movement of those elements, vibration and tremors in the adjoining earth and settlement phenomena in the adjoining earth. The tremors and settlement phenomena introduced into the adjoining earth in that way can seriously damage adjacent building structures. Such transverse movements are effectively and completely avoided by the described shoring device.

Eliminating the transverse movements makes it possible to use very long supports which are suitable for receiving a plurality of shoring panels and permit shoring of particularly deep trenches. Thus outer and inner shoring panels are guided in the receiving passages of the supports of EP 0 475 382 A1 so that a second pair of mutually opposite shoring panels is passed through between the first pair of shoring panels and inserted into the trench. The inner shoring panels are guided displaceably past the outer shoring panels and in the installed condition of the shoring device are in the lower portion of the trench whereas the outer shoring panels are in the upper portion of the trench. The trench is consequently of a stepped cross-section. Furthermore, both in the case of the outer shoring panels and also the inner shoring panels, it is possible to arrange on what are referred to as base panels of a first height (for example 2.35 m) fitment panels of a second height (for example 1.35 m) arranged between two successive supports, in which case the base panel and the fitment panel are respectively fixedly joined together. The total height of the shoring panels is then about 7.40 m.

Systems discussed herein may also be used in connection with a trench shoring device in which the supports are not separate components to which the plates are vertically displaceably fixed, but those in which the supports or the linear guides are rigidly fixed to the plates or integrated into the plates. DE 42 26 405 A1 in which the applicant is listed as inventor describes and shows in FIG. 2 such a device in which the supports having the linear guide are welded to the vertical edges of the shoring panel. Such shoring panels with linear guides, arranged at the two vertical edges, for the spreading frames generally form individual shoring arrays or shoring boxes. A shoring array comprises two mutually opposite shoring panels and two spreading frames which are guided on the one hand between the front edges of the two shoring panels and on the other hand between the rear edges of the two shoring panels. In addition it is possible to provide what is referred to as a head shoring, that is to say a head plate which extends transversely relative to the trench and which is supported against the front edges and a head plate which is supported against the rear edges of the two shoring panels.

A large number of different procedures for achieving great trench depths have been proposed in the state of the art. Thus the documents DE 32 43 122 A1, DE 26 54 229 A1, DE 23 02 053 B2 and FR 2 222 867 disclose two supports displaceable relative to each other in their longitudinal direction on each side of the trench. A single shoring panel is held in each of those supports. The supports are held at a spacing by spreading struts which are either hingedly fixed to the supports or, as in the case of DE 23 02 053 B2, are guided on the supports displaceably by way of spreading heads. When a support of a pair, upon installation or removal of the shoring device, is moved vertically with respect to the other support, then the spreading struts always perform a tilting movement about the longitudinal axis of the trench. That causes a reduction in the spacing between the spreader ends and thus between the supports of the pair of supports. Even if the spreading heads are guided displaceably on the supports the spreading struts perform a tilting movement under load because of the friction of the spreading heads in the guides of the supports. For that reason only small relative movements between the supports of a pair are permissible and the inclination of the spreading effect may not be more than 5° relative to the horizontal. Apart from the fact that in practice those limits are not always observed, even slight changes in the spacing between the supports of a pair have the result that the supports and the shoring panels can only be moved with very great difficulty and that settlement phenomena occur in the adjoining ground and endanger the adjoining buildings and structures (pipes, conduits etc).

In addition those shoring devices are generally installed simultaneously on each side with both mutually displaceable individual supports. In other words, both individual supports are placed on the earth and after the trench has been dug out to a certain depth of the trench are pressed into the ground. The trench can only be dug out within the supports and the shoring panels as the excavator bucket does not reach the earth beneath the supports and the shoring panels. The earth under the supports and the shoring panels is cut away by the lower edge of those elements when they are pushed in and drops into the interior of the trench. For that reason the lower edges of the supports and shoring panels extend inclinedly and form a cutting edge which pushes the earth inwardly upon being moved downwardly (see DE 32 43 122 A1). As the supports are generally fitted simultaneously in the known shoring devices, the outer support, upon being pushed into the ground, must displace not just the earth under its cross-section but also the earth beneath the inner support, inwardly of the trench. This means that very high forces are required to press the supports into the ground. The requirement for cutting away ground of double the support width means that the forces become so high that either they overload the support material or they cannot be applied by usual construction equipment.

DE 32 43 122 A1 describes a shoring device having a first pair of supports and a second pair of supports. The supports of the second pair bear against the insides of the supports of the first pair and are linearly guided thereat. At the supports of the first pair, the edges of upper and outer shoring panels are guided displaceably. The edges of lower and inner shoring panels are guided displaceably at the supports of the second pair. The upper outer supports of the first pair are held at a spacing above the lower inner supports of the second pair by a spreading strut—referred to as a transverse strut in DE 32 43 122 A1. Two transverse struts between the lower inner supports hold the inner supports at a spacing and press them against the outer supports. When the inner supports are not present the support frame formed solely by the outer supports is unstable. When shoring deep trenches it is therefore necessary for the upper outer supports of the first outer shoring device to be fitted into the trench only together with the lower inner supports of the second inner shoring device. Furthermore, that operation of inserting the outer and inner supports must be effected pair-wise so that very high weights have to be lifted and moved. In addition the lower support must be shorter than the upper one in order to be able to be inserted beneath the spreading strut between the supports of the upper pair.

For those reasons shoring devices with two individual supports which are displaceable vertically relative to each other and which have the linear guides disposed on each side of the trench have not proven satisfactory in the past. For shoring deep trenches, use is primarily made of the above-described shoring devices with supports which are held at a spacing by a displaceable spreading frame, in which upwardly disposed outer and downwardly disposed inner shoring panels are guided displaceably for forming a stepped cross-section. By virtue of the above-described avoidance of transverse movements upon installation and in the retreat mode, those devices, as mentioned, avoid adverse effects on the adjoining ground.

Accordingly, it would be desirable to develop a method of trench shoring in such a way that, with simple insertion and removal of the shoring device used in this respect, it is possible to line trenches of great depth. It would also be desirable to develop the elements of a device for trench shoring in such a way as to permit shoring of trenches of great depth.

SUMMARY OF THE INVENTION

According to the system described herein, a second pair of linear guides is inserted between a first pair of linear guides, wherein a respective linear guide of the second pair of linear guides is connected to a shoring panel of the second pair of shoring panels and the linear guides of the second pair of linear guides are held at a spacing by a spreading means, the spreading frame between the first pair of linear guides is removed, and when the trench is further dug out the second pair of shoring panels and the second pair of linear guides are lowered and a stiff spreading frame is inserted between the first pair of linear guides.

In other words, after complete installation of the first shoring device between a pair of linear guides (in the case of separate supports between a pair of supports) of the first shoring device at least one spaced-apart pair of linear guides of a second shoring device is inserted, which takes over the function of the spreading frame for the linear guides of the first shoring device. The pair of linear guides of the second shoring device is in turn held at a spacing by means of at least one spreading means disposed therebetween. That spreading means is preferably itself a flexurally stiff spreading frame guided displaceably between the pair of linear guides of the second shoring device. That ensures that upon installation of the second shoring device the parts thereof also move exclusively in a vertical direction relative to each other and consequently harmful transverse movements are avoided.

After the pair of linear guides of the second shoring device is inserted the spreading frame of the first shoring device can be removed as the pair of linear guides of the second shoring device with the spreading means disposed therebetween carries the pressure forces of the trench walls, acting inwardly on the shoring panels. The linear guides of the second shoring device and the shoring panels of the second shoring device, which are disposed within the shoring panels of the first shoring device and which are respectively connected to at least one of the linear guides of the second shoring device can now be lowered when the ground is further dug out. As soon as the pair of linear guides of the second shoring device has been lowered into the trench by a certain depth, a spreading frame is again inserted between the linear guides of the pair of the first shoring device, to hold the first pair of linear guides at a spacing. In that case the spreading frame is preferably inserted from above between the first pair of linear guides. Upon further lowering movement of the second shoring device if required a further spreading frame can be inserted between the first pair of linear guides.

The second shoring device can thus be lowered over the entire length of its linear guides so that the method of the invention substantially doubles the maximum shoring depth limited by the forces occurring upon installation and upon retreat.

In other words, a complete shoring device with spreading frame is pushed and lowered through the shoring device which is already in place. That is made possible by the fact that, upon insertion of the second shoring device, the pair of linear guides thereof take over the support forces acting on the first shoring device while the spreading frame of the first shoring device is removed for the second shoring device to pass through. Later, when the pair of linear guides of the second shoring device moves further downwardly out of the pair of linear guides of the first shoring device, a spreading frame is again pushed from above between the linear guides of the first shoring device, to ensure that the pair of linear guides of the first shoring device is reliably held at a spacing while the second shoring device is increasingly moved downwardly.

This therefore involves a method of supporting trench walls by means of oppositely disposed shoring panels. The trench walls can extend simply or in a stepped configuration. The shoring panels can be guided in positively locking relationship in vertical guide rails or similar means having linear guides. The shoring device is moved downwardly relative to the earth by means of an excavator, as the trench is dug out. Arranged between the vertical rails is the spreading frame (often also referred to as the flexurally stiff frame carriage or slider) which acts as a spreading means and is displaceable in the vertical rails. As the length of the vertical rails or the resulting trench wall height is limited by virtue of the mechanical action of the earth the final depth of that described system is doubled insofar as a complete new shoring system is fitted, similarly to that described hereinbefore, into the already placed system. In that case new vertical rails with linear guides are inserted between the vertical rails which have already been fitted in place. A specific dedicated spreading frame is inserted into those new vertical rails. Those inwardly extending rails (second pair of linear guides) have preferably and as described in detail hereinafter on the back a guide element, for example a guide rib or bar which engages into the outer linear guide (for example a vertical guide passage) on the inside of the vertical rails of the outer shoring device, the spreading frame (frame carriage) being guided in that outer linear guide. The spreading means (frame carriage) now has to be widened between the inner linear guides by means of a special spreading device described hereinafter in such a way that a force-locking connection is produced between the outer and inner linear guides (outer and inner rails). Then the complete inner frame comprising the two inner linear guides (vertical rails) and the inner spreading means (frame carriage) is moved downwardly so that the frame carriage is lowered between the outer linear guides which are already installed, on to the floor of the trench, and can be removed by means of a special opening in the lower region of the outer linear guide (see below). The total earth pressure on the firstly installed shoring device is now carried by the spreading frame between the inner linear guides (vertical rails).

Then the inner vertical rails are further lowered with the corresponding shoring panels, by means of an excavator. As soon as the inner shoring device with the inner vertical rails and the inner spreading means has been sufficiently lowered, the outer previously removed frame carriage is re-inserted above the inner shoring device. That frame carriage carries the earth load acting on the outer vertical rails, after further lowering movement of the inner shoring device, when the inner shoring device has come downwardly out of the outer vertical rails by virtue of further lowering movement between the inner vertical rails.

The basic idea involves installing a second shoring array of equal length through a shoring array which has already been installed and comprises large-area shoring panels which are connected to vertical guide rails which in turn are supported against the earth by a flexurally stiff spreading frame (frame carriage), wherein the new special spreading frames of the first and second shoring arrays alternately take over carrying the load acting on the array which is already installed.

That method is also suitable for shoring arrays in which the vertical linear guides are integrated in the shoring panels—so called edge-supported shoring panels—if they are equipped with a flexurally stiff spreading frame. The flexurally stiff spreading frames (also referred to as frame carriages or sliders) then alternately carry the load if an edge-supported shoring system of equal length is guided through one which is already in place.

In the case of an individual shoring array, moving a shoring array through an already installed shoring array of equal length ensures that the desired trench length is observed at the floor of the trench and also at the upper edge thereof. In the case of a shoring array with two pairs of supports at which the two pairs of linear guides are arranged and between which the edges of the shoring panels are held displaceably, identity of the length of the outer and inner shoring arrays is advantageous because a shoring array can adjoin the next one without any transition, over the entire depth of the lined trench.

As mentioned preferably a stiff spreading frame is used as the spreading means between the second pair of linear guides or pair of supports of the second shoring device. The stiff spreading frame is preferably spread open in practice under high pressure after insertion of the second shoring device into the first one. As a result the linear guides of the second pair are pressed under a high force against the linear guides of the first pair. Any play which is present during insertion of the linear guides of the second shoring device is eliminated by the spreading action. Upon subsequent removal of the spreading frame of the first shoring device, that elimination of play means there is no longer the risk of the linear guides of the first shoring device being displaced inwardly and settlement phenomena occurring in the earth supported by the shoring panels of the first shoring device.

In practice a hydraulic spreading device can be pressurized for spreading the spreading frame of the second shoring device. That makes it possible to produce high spreading forces which completely carry the pressure forces produced by the shoring panels of the first shoring device.

It should be ensured that the spreading frame provided with the spreading device is just as flexurally stiff as the spreading frame without additional spreading device. For that purpose in practice after the spreading operation a locking element can arrest the spreading frame of the second shoring device in the spread position. To do that a locking plate may be inserted between and screwed to two connecting flanges of the spreading frame of the second shoring device. That then again affords a rigid connection comprising highly loadable steel elements between the guide elements of the second spreading frame. The spreading device, preferably a hydraulic cylinder, is no longer subjected to the effect of support forces in further use as they are transmitted completely by way of the locking plate inserted between the two connecting flanges.

In the same way the spreading frame which, after lowering of the second shoring device by a given distance, is again inserted between the linear guides of the first shoring device, can be spread. That relieves the pressure on the support frame of the second shoring device so that no frictional forces which impede the lowering movement of the second shoring device occur between the shoring devices.

The inner frame formed by the inner linear guides of the second shoring device may be inserted from above between the linear guides of the first pair. The second shoring device is consequently lowered in a pre-assembled condition with spreading frames arranged therebetween into the first shoring device.

In practice the spreading frame of the first shoring device can be displaced prior to removal into the lower region of the first linear guides of the first shoring device. In that way the support frame of the second shoring device can be inserted by the major part of its length between the linear guides of the first shoring device in order there to carry the load before the spreading frame of the first shoring device is removed.

In a practical embodiment the linear guides are arranged at the mutually opposite insides of two supports of a pair of supports of the first shoring device. Guide elements arranged at the outsides of the spreading frame co-operate in positively locking relationship with those linear guides. After displacement of the spreading frame into the lower region of the first pair of linear guides the positively locking engagement with the guide elements can be released. In that way the guide elements can be removed from the linear guides inwardly of the trench and the spreading frame can be removed.

If for example the linear guides are guide passages in which guide elements (for example guide rails) arranged at the outsides of the spreading frame are displaceably accommodated in positively locking relationship, openings through which the guide elements are removed from the guide passages can be arranged in the lower region of the passages. However any other method of releasing the positively locking engagement between the guide elements of the spreading frames and the linear guides of the first pair is also possible. For example the guide elements can be screwed together. Those guide elements can be dismantled and taken apart to release the positively locking engagement.

The spreading frame of the first shoring device can also be drawn together inwardly to remove its guide elements from the guide passages. Since, as mentioned above, a spreading frame is preferably telescopic in order to be spread to carry the support loads, it can conversely be drawn together upon dismantling in order to be removed from the linear guides inwardly of the trench. It is sufficient for them to be drawn together by a few centimeters in order to eliminate the pressure force acting on the support frame and then to dismantle same without an external load so that it can be removed from the trench.

The spreading frame may be screwed together from various steel elements. In a spreading frame of that kind at least one screw connection can be released prior to removal Thereof. The spreading frame can then be dismantled and removed between the linear guides of a pair of the first shoring device.

For example, upon removal of the spreading frame of the first shoring device, a spreading element of the spreading frame can be released and removed and then the further elements of the spreading frame can be removed inwardly of the trench. As described in greater detail in relation to the drawings, a spreading frame of a practical embodiment comprises two carriages guided displaceably on the linear guides and spreading tubes arranged between those carriages. After removal of the spreading tubes the carriages can be removed inwardly of the trench.

In practice the linear guides provided for example at the mutually opposite insides of two supports of a pair of supports of the first shoring device can be provided by guide passages in which guide elements arranged at the outsides of the spreading frame are displaceably accommodated in positively locking relationship. The linear guides (for example supports) of the second shoring device can then also have at their outsides guide elements guided displaceably in the guide passages of the first shoring device. The guide elements at the outsides of the linear guides of the second shoring device are in positively locking relationship with the outer guide passages, in the longitudinal direction of the trench. Thus the inner linear guides of the frame guided between the outer linear guides cannot tip over forwardly or rearwardly. Towards the interior of the trench the linear guides of a pair of linear guides of the second inner shoring device are supported by the spreading frame disposed therebetween.

In practice the supports which occur in succession along a trench wall, with the linear guides of the first shoring device, can have mutually opposite receiving passages in which the shoring panels of the first shoring device are displaceably guided. That corresponds to the embodiments, known from the state of the art, for shoring devices with separate supports for supporting the plate edges. An outer and upper shoring panel and an inner and lower shoring panel can be guided displaceably in the mutually opposite receiving passages of two successive supports of the first shoring device in order to achieve a maximum shoring depth of the first shoring device and a trench of stepped cross-section.

The supports of the second shoring device, that occur in succession along a trench wall, can also have mutually opposite receiving passages in which the shoring panels of the second shoring device are guided displaceably. An outer and upper shoring panel and an inner and lower shoring panel can also be guided displaceably in the mutually opposite receiving passages of two successive supports of the second shoring device.

As mentioned, in that way the attainable shoring depth of a simple known shoring device with flexurally stiff spreading frame can be doubled. As the outer and inner shoring devices extend over the same height, connection of a first shoring device to a second one over the entire trench height is possible without any problem. It should be noted that this method can be repeated and a third shoring device can be inserted and lowered between the supports or linear guides of the second shoring device from above, wherein before lowering of that third shoring device the spreading frame of the second shoring device is removed in the region of the trench floor. The attainable shoring depth can be still further increased in that way. Higher laterally acting forces on the shoring panels are not to be expected at a greater depth as the force, acting from above, of the earth masses bearing thereagainst, due to by virtue of the internal friction in the ground (arch effect) is converted into transverse forces, only to a slight extent.

As mentioned above the system described herein also concerns elements of the shoring device which by virtue of their particular configuration permit the increase in shoring depth according to the system described herein.

Thus the system described herein also concerns a linear guide for the spreading frame of a trench shoring device, wherein the linear guide co-operates with at least one guide element of a displaceable spreading frame in positively locking relationship.

To permit removal of the spreading frame after displacement thereof into the lower region of the linear guide, the linear guide in the lower region is so designed that the positively locking relationship with the guide element can be released.

Again the linear guide can be integrated into the shoring panels and arranged at their edge. Alternatively it can be part of a support separate from the shoring panels, wherein the two vertical edges of a shoring panel are held by a respective support at the beginning and end of a shoring array.

If the linear guide is a guide passage into which the guide element of a spreading frame is insertable in positively locking relationship, at least one opening can be arranged in the lower region of the guide passage, through which opening the guide element is removable inwardly of the trench. As described above after insertion of a pair of supports of a second inner shoring device the spreading frame near the floor of the trench can be removed by its guide elements being removed inwardly through the opening in the lower region of the guide passage.

At least one abutment may be associated with the linear guide, to limit the displacement movement of the spreading frame in the linear guide. For example the linear guide can have at least one aperture and the abutment can have a pin which can be inserted into the aperture. When a pin is inserted into openings provided for same just above and below the spreading frame, the displacement distance is reduced to a minimum and the spreading frame is held substantially stationarily between the linear guides. That is helpful during insertion of a support frame with two linear guides or a shoring array with four support frames at the vertical edges of two mutually opposite shoring panels, into the trench. Upon further lowering of the linear guides the abutments are released so that the individual components of the shoring device are movable relative to each other. It will be noted however that an abutment should still limit the displacement of the spreading frame at least downwardly to avoid the spreading frame being displaced into the region in which the positively locking engagement with the linear guide is released.

In addition, if such a linear guide is used in an inner shoring device, at least one guide element can be associated with the linear guide at the outside facing towards the outside of the trench, the guide element co-operating with an outwardly disposed linear guide of an outer shoring device in positively locking relationship in such a way that the two linear guides are displaceable relative to each other in their longitudinal direction. That guide element ensures that the linear guide which is displaced as a component of the inner shoring device between an outer pair of linear guides cannot tip forwardly or rearwardly. That is particularly significant if the linear guides are arranged on supports and two supports together with a spreading frame arranged between them form a support frame. The supports of the inner support frame are held at a spacing inwardly by the spreading frame arranged between them and are pressed against the outer linear guides.

According further to the system described herein, a support system for a trench shoring device may comprise a pair of inwardly disposed supports which at the inside facing towards the inside of the trench have at least one linear guide which co-operates in positively locking relationship with at least one guide element of a spreading frame which is displaceable along the support and which holds the inwardly disposed pair of supports at a spacing, a pair of outwardly disposed supports which are displaceably guided at the inwardly disposed supports in the longitudinal direction of the supports, and fixing devices arranged at the supports for fixing large-area shoring panels between two successive supports on a side of the trench.

In accordance with an aspect of the system described herein, there may be provided at least one roller arrangement which reduces the friction between the mutually facing faces of an outwardly disposed support and an inwardly disposed support. The rollers provide for easily movable displaceability of the inner support frame in relation to the outer pair of supports.

In practice, rollers can be mounted rotatably about horizontal axes on the inwardly disposed support, the periphery of the rollers projecting beyond the face of the inwardly disposed support, that faces the outwardly disposed support.

According further to the system described herein, a flexurally stiff spreading frame may include guide elements at its outsides, which are intended to co-operate in positively locking relationship with a pair of mutually facing linear guides. In accordance with a first aspect of the system described herein, the guide elements are fixed releasably to the spreading frame to permit removal of the spreading frame between the two supports of a pair. In accordance with a second aspect of the system described herein the spreading frame has a spreading device with which the spacing between the outsides of the spreading frame is variable to permit spreading of a frame comprising the two linear guides and the spreading frame. The spreading device may include a hydraulic pressure cylinder.

In addition the spreading frame can have two connecting flanges whose spacing is variable by means of the spreading device and between which a locking plate of selectable thickness can be fixed. In that way, after the spreading operation, the spreading frame can be arrested in the spread position by means of the locking plate, wherein after arresting it again presents its rigid structure and its high flexural stiffness. The hydraulic pressure cylinder is preferably arranged in the region of a frame member of the spreading frame. Integration of the pressure cylinder into the frame member means that only few handling steps are required during insertion of the second shoring device into the first shoring device in order to take over the forces acting on the outer linear guides, by spreading of the inner spreading frame between two inner linear guides. It is only necessary to open a screw means of the spreading frame and to pass a hydraulic medium into the pressure cylinder under pressure in order to spread the spreading frame. The locking plate can then be inserted and the arresting screws tightened on the connecting flanges to arrest the spreading frame in flexurally stiff relationship in the spread position. In a preferred embodiment of the spreading frame the connecting flanges can be arranged in the region of the abovementioned frame member with the pressure cylinder.

BRIEF DESCRIPTION OF THE DRAWINGS

Embodiments of the system described herein are explained hereinafter with reference to the accompanying drawings in which.

DETAILED DESCRIPTION OF VARIOUS EMBODIMENTS

FIGS. 1 through 38 concern embodiments of the system described herein in which a shoring array of a shoring device comprises four supports, at least two spreading frames and at least two shoring panels. The four supports at their insides have the linear guides for the spreading frames and are assembled to form two pairs of supports, between which a respective spreading frame is displaceably guided. The edges of the shoring panels are displaceably fixed to the supports. FIGS. 39 through 42 in contrast show an embodiment of the invention without separate supports. Here the linear guides are arranged directly at the edges of the shoring panels.

FIGS. 1 through 9 show the installation of a shoring array of a first shoring device with supports according to the system described herein. That installation operation is followed by the shoring method according to the system described herein.

Figure 1:
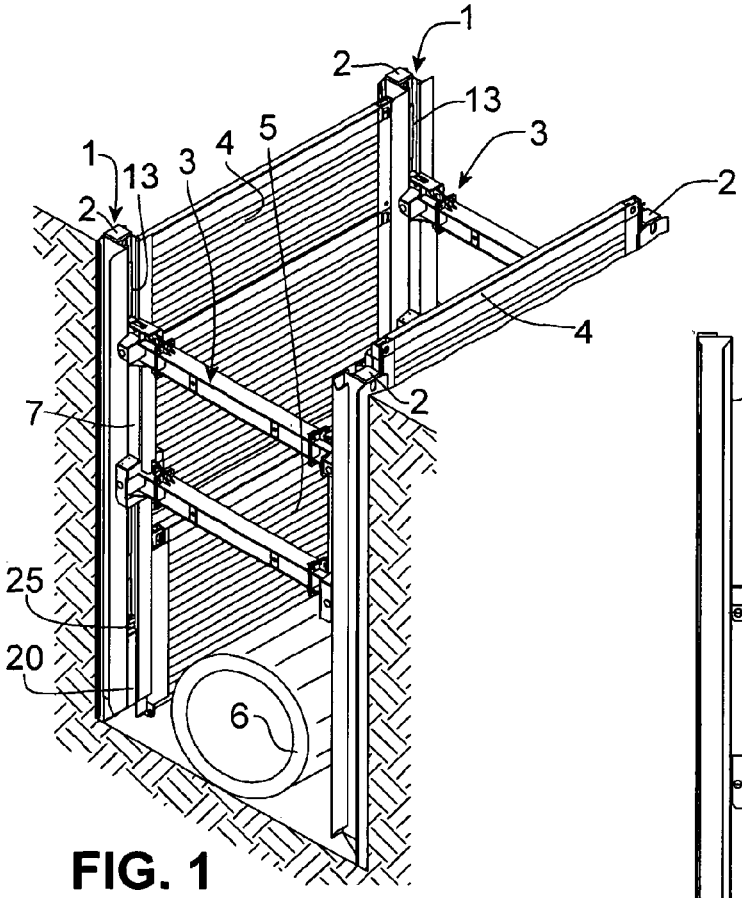
FIG. 1 shows a perspective view of a shoring array of a shoring device according to the system described herein with spreading frames in the installed condition.

FIG. 1 shows a shoring array of the first shoring device in a trench, in which a pipe portion 6 is laid. The shoring array of the shoring device includes two support frames 1. Each support frame 1 has two supports 2 arranged in mutually opposite paired relationship. A flexurally stiff spreading frame 3 is arranged between those supports 2 displaceably in the longitudinal direction of the supports 2. At its inside facing towards the interior of the trench each support 2 has a guide passage 13 forming a vertical linear guide and in which the spreading frame 3 is vertically displaceably guided.

The lower region 20 of the guide passage 13 is enlarged, as described in greater detail hereinafter. So that the spreading frame 3 is not pushed into the enlarged region 20 an abutment 25 is disposed above the enlarged region 20. The abutment 25 is shown in FIG. 1 in the form of a locking bolt arranged transversely to the guide passage 13. It is however also possible to use any other means such as for example push-in bolts which can be inserted into apertures 50 (see FIG. 30), as the abutment. It is also possible to use an abutment which is displaceable in the receiving passage 13 and which can be clamped fast therein to limit the displacement travel of the spreading frame 3.

Figure 2:
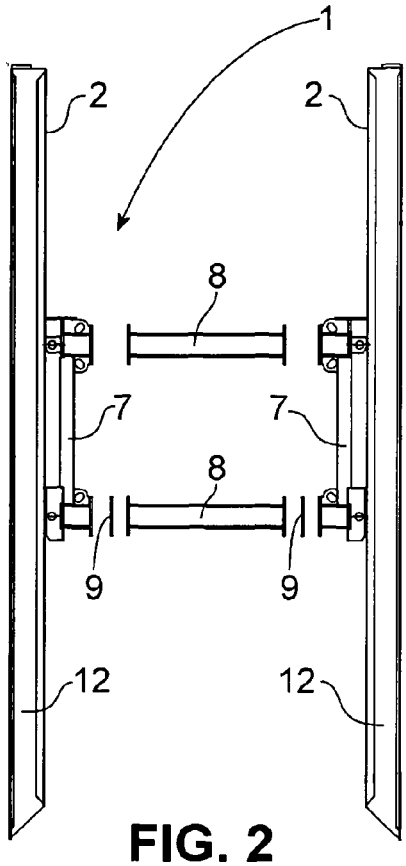
FIG. 2 shows a front exploded view of a support frame of the FIG. 1 shoring device.

FIG. 2 shows the individual parts of a support frame 2 with dismantled spreading frame 3. The spreading frame 3 comprises two carriages 7 which are longitudinally displaceably guided in the linear guide of a respective support 2. Spreading tubes 8 are fixed between the carriages 7 by means of screws (not shown). In addition spacer plates 9 are disposed in the region of the lower spreading tube 8. The spacer plates 9 compensate for the clearance of the linear guide for the carriages 7. In the region of the lower spreading tube 8 the spreading frame 3 is subjected to a compression loading whereas in the region of the upper spreading tube 8 it is subjected to a tensile loading. The spacer plates 9 provide that, in spite of the clearance between the spreading frame and the lateral supports 2, the lateral supports 2 are oriented in mutually parallel relationship.

Figure 3:
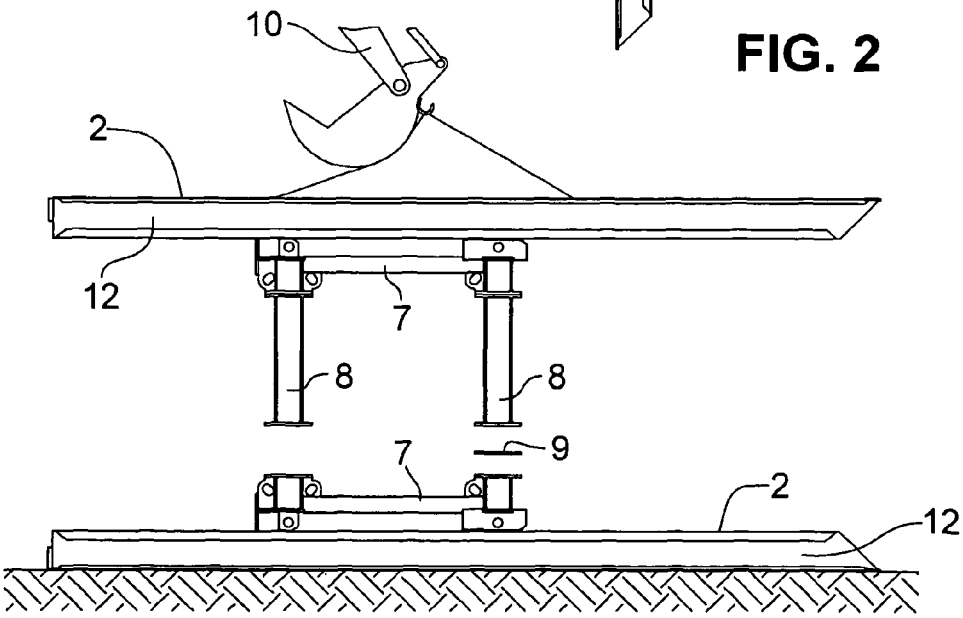
FIG. 3 shows a front view of the support frame of FIG. 1 upon assembly.

As can be seen from FIG. 3 firstly a support 2 with a carriage 7 is laid down on ground which is as flat as possible. A suitable item of lifting equipment, for example the boom 10 of a bucket excavator, is used to lift the second support 2 with the carriage 7 fixed thereto and the spreading tubes 8 and position it over the first support 2. The lower screws are then fitted so that the flexurally stiff spreading frame 3 is closed and the support frame 1 is completed. The boom 10 of the bucket excavator 11 then lifts the support frame 1 so that the two supports 2 extend vertically and parallel to each other (see FIG. 4). The support frame 1 in that orientation is inserted into a preliminary trench diggings for the shoring array. The preliminary trench diggings was previously implemented by means of a bucket excavator 11.

Figure 4:
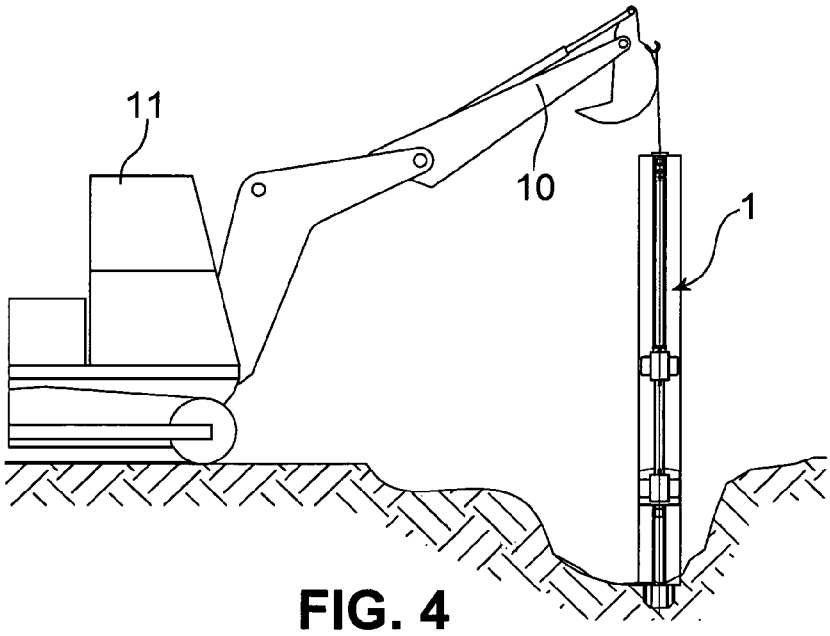
FIG. 4 shows a side view of the support frame when being set up in the preliminary diggings of a trench.

Depending on the respective solidity of the ground the preliminary trench diggings is to be effected to a depth of between 1 m and 1.5 m. The first support frame 1 is inserted into the preliminary diggings, as FIG. 4 shows.

Figure 5:
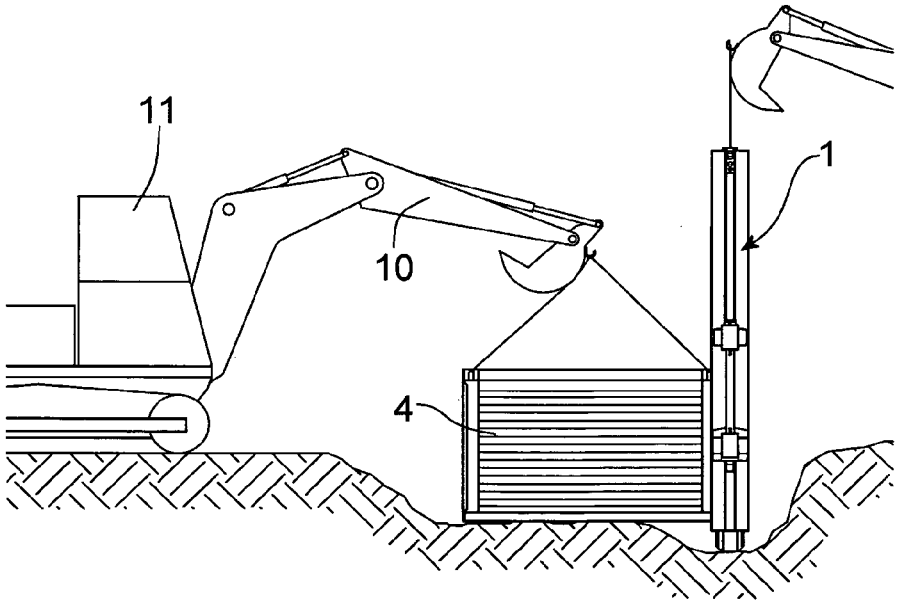
FIG. 5 shows a side view of the support frame upon insertion of the outer shoring panels.
Figure 6:
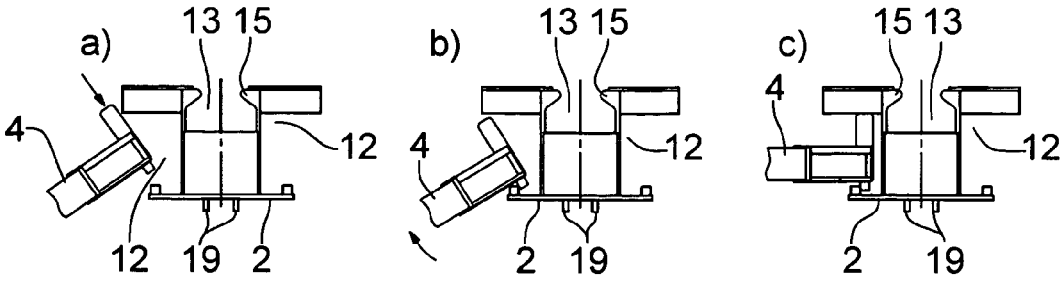
FIG. 6 shows three plan views of a support with the end of the outer shoring panels during insertion into the support.

Thereafter the outer shoring panels 4 are inserted into the beam profile of the supports 2. That operation is shown in FIGS. 5 and 6. A large-area shoring panel 4 of steel is lifted with an excavator boom and moved with an edge into the proximity of the profile of one of the supports 2. As can be seen in particular from FIG. 8 the supports 2, on the two sides which are at the front and at the rear in the longitudinal direction of the trench, have receiving passages 12 into which the edges of the shoring panels 4, 5 can be inserted. As shown in FIG. 6 the edge of the outer shoring panel 4 is pivoted into a receiving passage 12 of the support 2.

Figure 7:
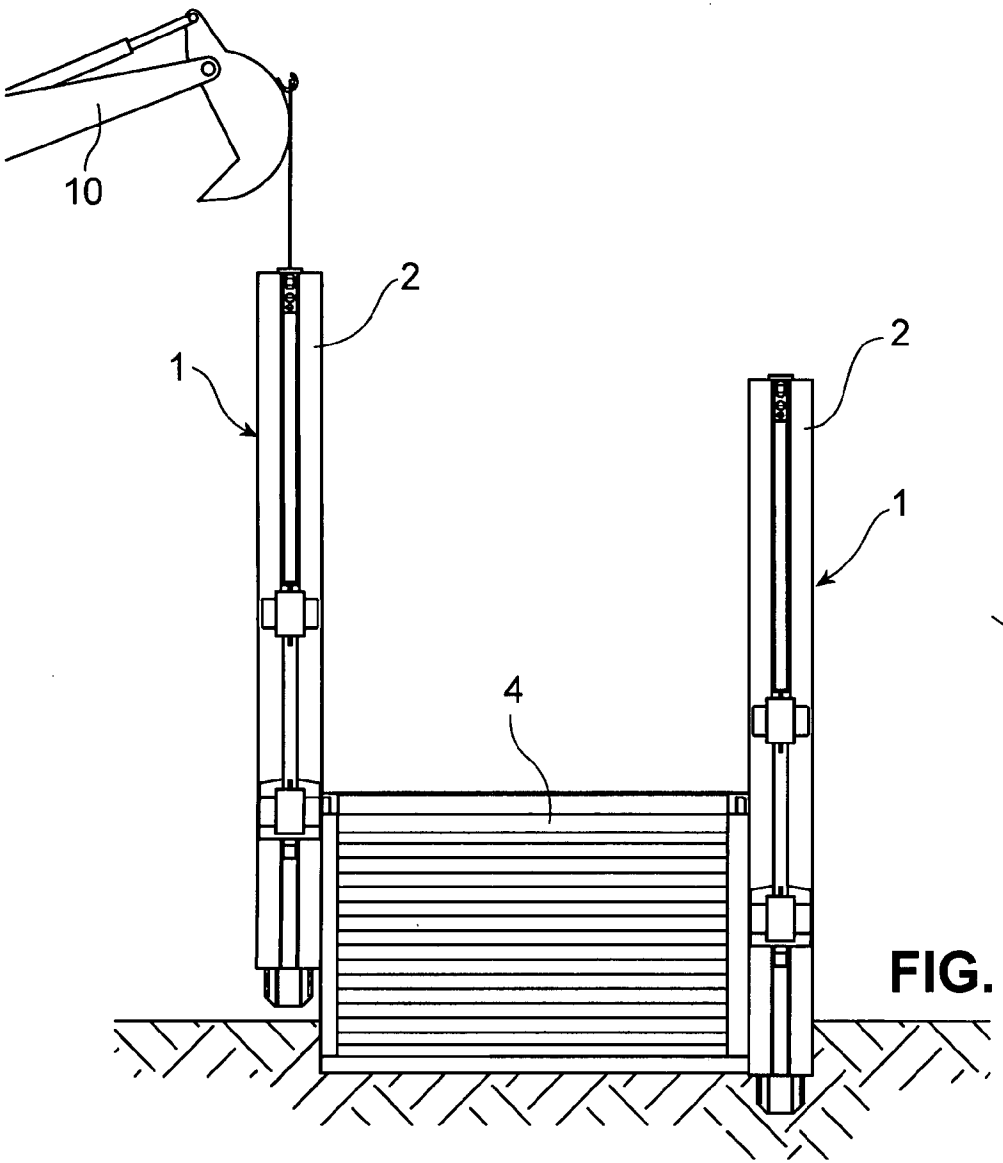
FIG. 7 shows a side view of the shoring array when setting the second support frame in position in the trench.

As FIG. 7 shows, a second support frame 1 is then lifted by the boom 10 of an excavator and lowered at the other end of the shoring panels 4 so that the edges of the shoring panels 4 are guided in the receiving passages 12 facing the shoring panels 4. The receiving passages 12 form the fixing devices which hold the outer shoring panels 4 between two consecutive supports 2 in the longitudinal direction of the trench, at one side of the trench.

The excavator then digs out the earth between the shoring panels 4 and the supports 2 and successively presses those components into the dug-out trench. In that respect, 30-40 cm of the earth is respectively dug out beneath the plate edges or the supports. The supports 2, the shoring panels 4 and the spreading frames 3 are alternately further pushed down, in which case those components are displaced in the vertical direction.

Figure 8:
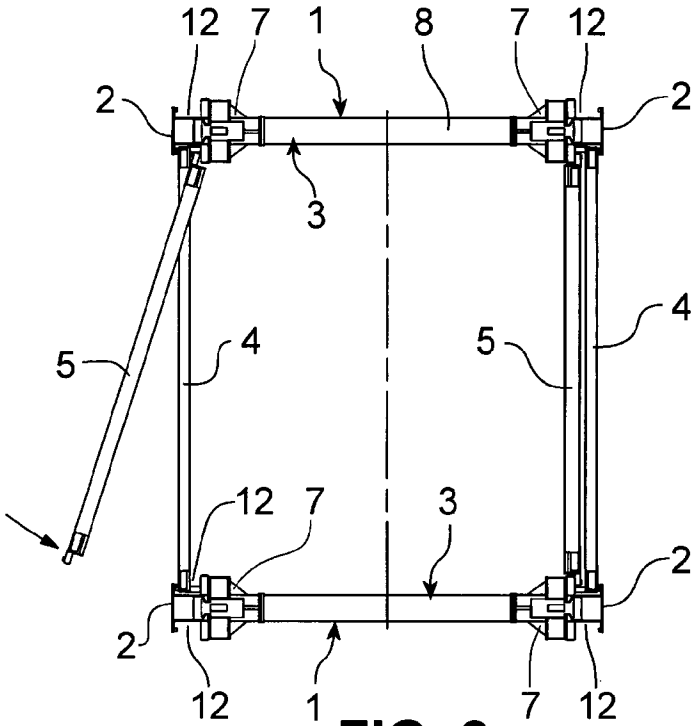
FIG. 8 shows a plan view of the shoring array upon insertion of the inner shoring panels.

When the outer shoring panels 4 are completely lowered into the ground, inner shoring panels 5 are inserted. As shown in FIG. 8 the inner shoring panels 5 are pivoted into the receiving passage 12 of the supports 2 above the outer shoring panels 4 and then lowered into the trench parallel to the outer shoring panels 4. When the trench is further dug out the inner shoring panels 5 are lowered, in which case the outer shoring panels 4 remain in the position shown in FIG. 9 in the upper region of the trench.

The outer shoring panels 4 and the inner shoring panels 5 can be for example divided into two to be able to implement different trench heights. The shoring panel portions can be fitted on to each other and fixedly connected together by connecting elements.

The total height of the inner shoring panel 5 and the outer shoring panel 4 respectively in the illustrated shoring device is generally not over 5 m as otherwise the pressure forces, frictional forces and torsional forces acting on the components become too great. In most cases the height of inner shoring panels 5 and outer shoring panels 4 comprising two plate portions is of the order of magnitude of 4 m. The length of the support 2 is about 8 m. Accordingly the greatest depth of a trench which can be supported with the shoring device illustrated is also mostly between 8 m and at most 10 m.

FIG. 10 shows once again as a detailed view in section the co-operating parts of the shoring device by means of the example of a left-hand support 2 of a support frame.

It can be seen that the supports 2 comprise an at least partially closed hollow box profile. The two sides of the support 2, which are at the front and the rear in the longitudinal direction of the trench, each have a respective receiving passage 12 in which the edges of outer shoring panels 4 and inner shoring panels 5 which are displaced inwardly of the trench are guided. Instead of a large open receiving passage 12 on each side of the support 2, supports are also known which have a respectively stepped receiving passage on each side or the two mutually parallel receiving passages on each side to guide the outer and inner shoring panel at the edge.

Further, at the side of the support 2 facing the interior of the trench, a guide passage 13 is shown which is open inwardly of the trench and forms a vertical linear guide. The guide passage 13 accommodates a guide rail 14 arranged on the outside of the carriage 7. The guide rail 14 engages in positively locking relationship behind edge bars 15 which laterally constrict the mouth opening of the guide passage 13. The positively locking engagement prevents the carriage 7 from being pulled out of its guide in the guide passage 13.

For easy displaceability of the carriage 7 along the support 2, arranged on the carriage 7 are rollers 16 which are rotatable about horizontal shafts 17 and roll on the face, inwardly of the trench, of lateral support flanges 18 of the support 2.

It is to be noted that easily movable displacement of a spreading carriage or spreading frame on a support can also be achieved by other linear guides at the inside of the support and by other guide elements, co-operating therewith, of the spreading frames, without thereby departing from the scope of the present invention.

Figure 9:
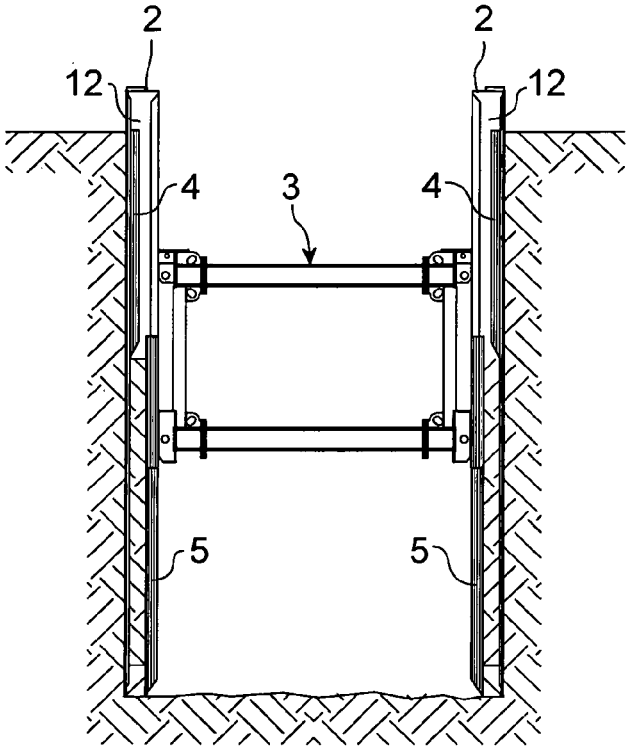
FIG. 9 shows a front view of the completely installed shoring device in accordance with the system described herein.
Figure 10:
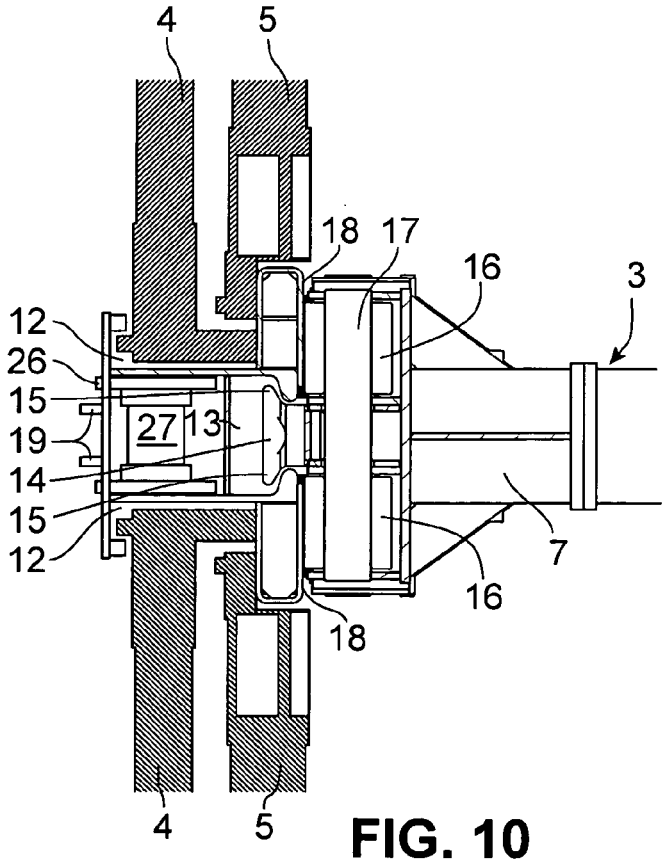
FIG. 10 shows a plan view of the left-hand support of a support frame of the shoring device shown in the preceding Figures.

FIG. 10 further shows a guide leg 19 on the outside of the support 2. That guide leg 19 has no function if the shoring device is installed alone (as shown in FIG. 9). It performs its function only when, in accordance with the invention, a second shoring device is inserted into the above-described first shoring device and is installed therethrough to a greater trench depth. That operation is shown in FIGS. 11 through 20.

The first FIGS. 11 through 13 once again summarize the above-described operation of installing a shoring device according to the state of the art. In this case, FIGS. 11 through 19 show solely the support frames 1 as a front view in a direction of viewing the arrangement parallel to the longitudinal direction of the trench. The shoring panels which laterally delimit the shoring arrays defined by the support frames can only be seen in FIG. 20.

Figures 11, 12, 13:
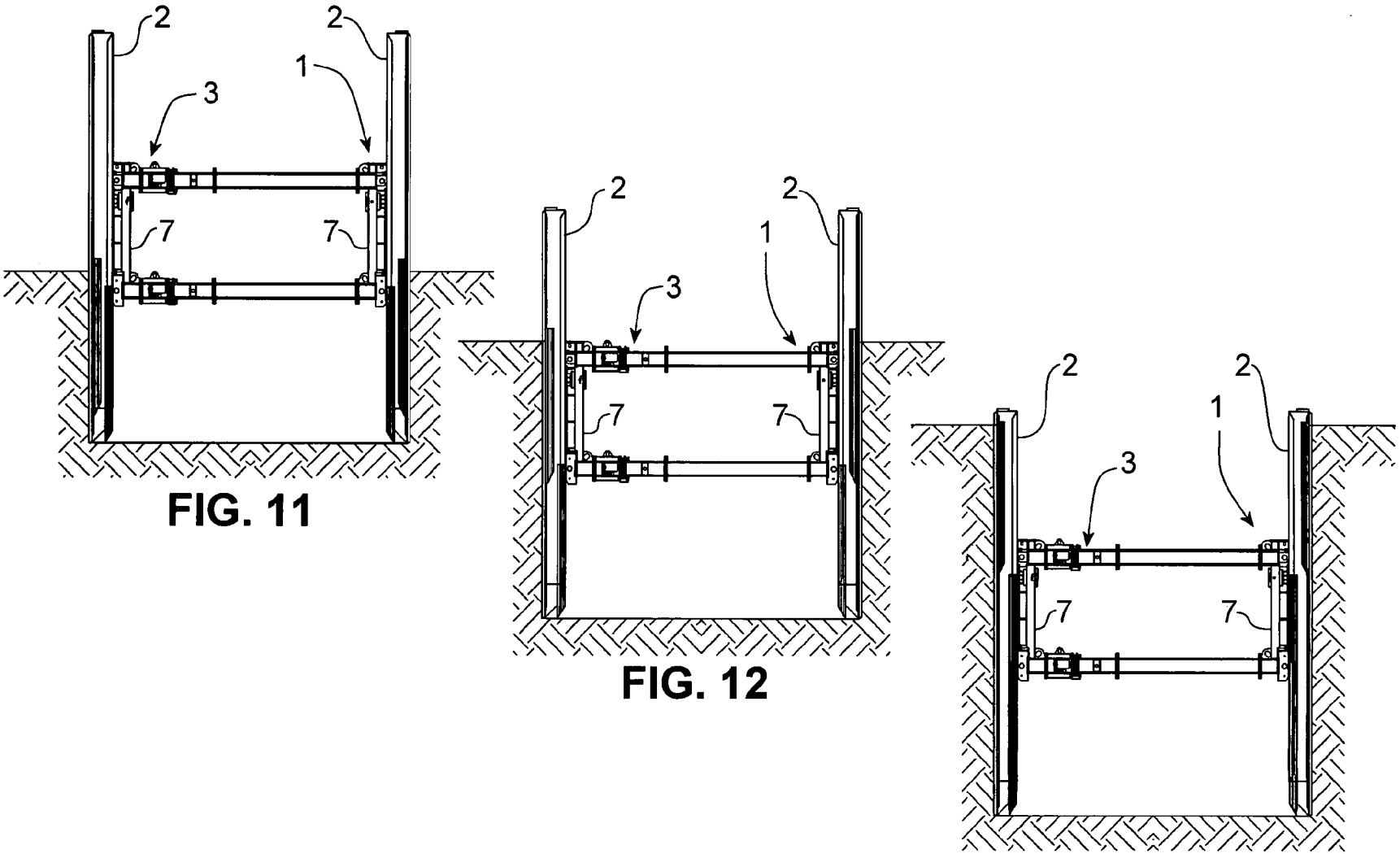
FIGS. 11 through 13 show three diagrammatic front views of a support frame of a first shoring device in three different installation depths.

FIG. 11, similarly to FIG. 5, shows how the support frame 1 is inserted into the preliminary diggings of the trench. FIG. 12 shows the support frame 1 upon further lowering movement of the shoring device, as described above. FIG. 13, similarly to FIG. 9, diagrammatically shows the support frame 1 in the completely installed condition.

Figure 14:
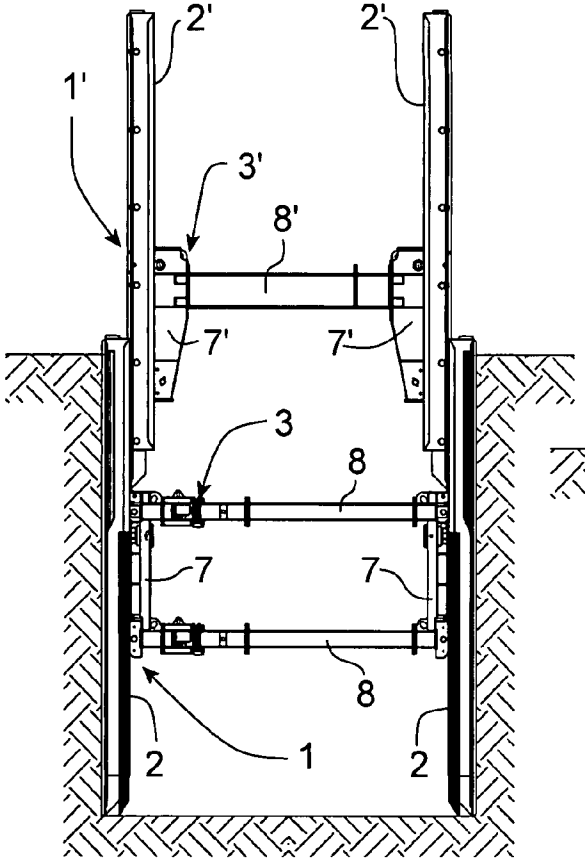
FIGS. 14 through 20 show a diagrammatic front view of the support frames of the first and second shoring devices for shoring greater trench depths.
Figure 15:
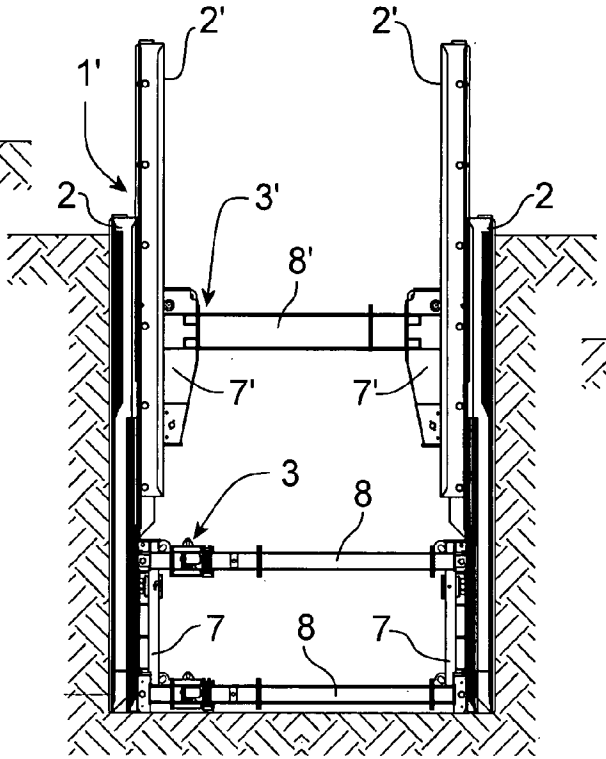
Figure 16:
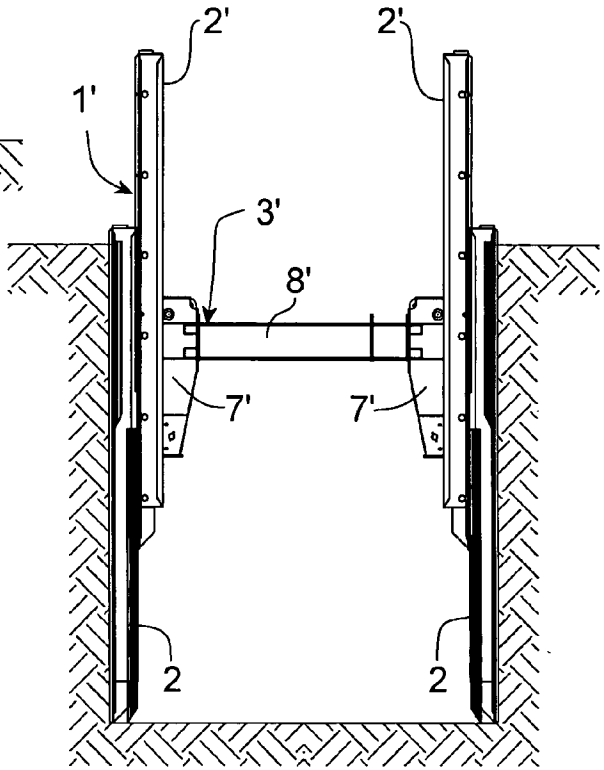

FIG. 14 shows the continuation according to the invention of the shoring method for achieving particularly great trench depths. Fitted into the first support frame 1 which is shown in this Figure and which is completely installed is a second support frame 1' of a second shoring device. For that purpose the support frame 1' is also suspended from a boom 10 of an excavator and pushed from above between the supports 2 of the first support frame 1 until the second support frame 1' is just above the spreading frame 3 of the first shoring device.

When the spreading frame 3' of the second inner shoring device is disposed substantially completely between the supports 2 of the outer shoring device (below the position shown in FIG. 14), it is spread apart until the supports 2' of the inner shoring device bear under a high pressure against the supports 2 of the outer shoring device. That provides that the spreading frame 3 is relieved of load, between the supports 2 of the outer shoring device. The spreading device for the spreading frames is described in detail hereinafter.

The spreading frame 3 of the first shoring device is firstly fixed at a given height of the supports 2, with the above-described abutment 25 (FIG. 1). After insertion and spreading of the second support frame 1' the abutment is removed and the spreading frame 3 of the first support frame 1 is moved completely downwardly as far as the floor of the trench (see FIG. 15). Here the first spreading frame 3 between the outer supports 2 of the first shoring device is removed. The earth pressure acting on the outer supports 2 of the first shoring device is transmitted by way of the inner supports 2' to the spread spreading frame 3' of the second inner shoring device.

It can be seen from the Figures that the spreading frame 3' is of a different form from the spreading frame 3. The spreading frame 3, as in the embodiment of FIGS. 1 through 9, is of a substantially rectangular form with an upper and a lower spreading tube 8 between the lateral carriages 7 whereas the spreading frame 3', between the lateral carriages 7', has only one spreading tube 1' comprising a rectangular hollow box profile. The spreading frame 3' is thus substantially of a downwardly open U-shaped form. Other spreading frames are also known, which for example are of an H-shaped form with a single tube portion in the central region of the carriages. Any forms of spreading frames 3, 3' can be used for carrying the invention into effect. Any kind of spreading frame 3, 3' is advantageously provided with a spreading device so that it is spread open upon insertion between the two supports of a shoring array already installed in the trench, to carry the load.

Figure 21:
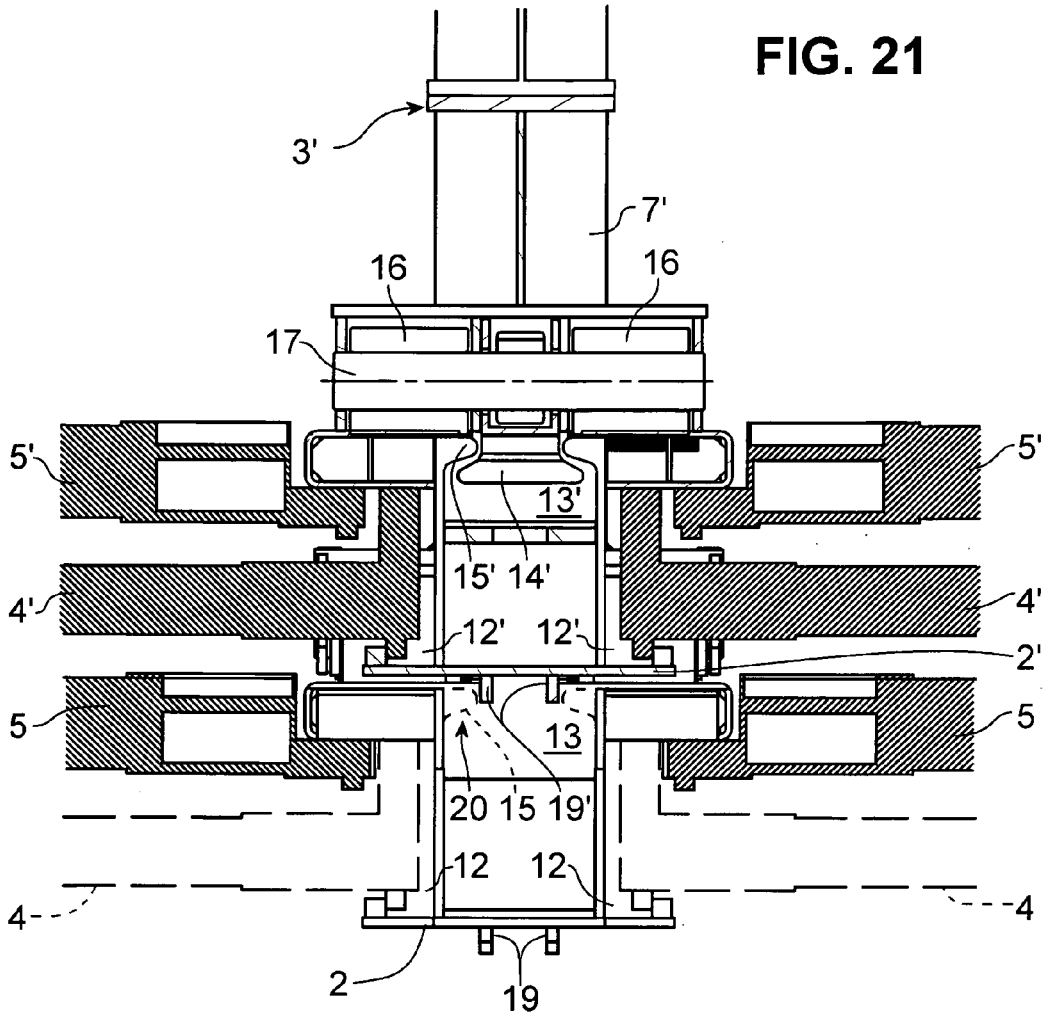
FIG. 21 shows the view x-x of the left-hand supports of the shoring device of FIG. 20.
Figure 29:
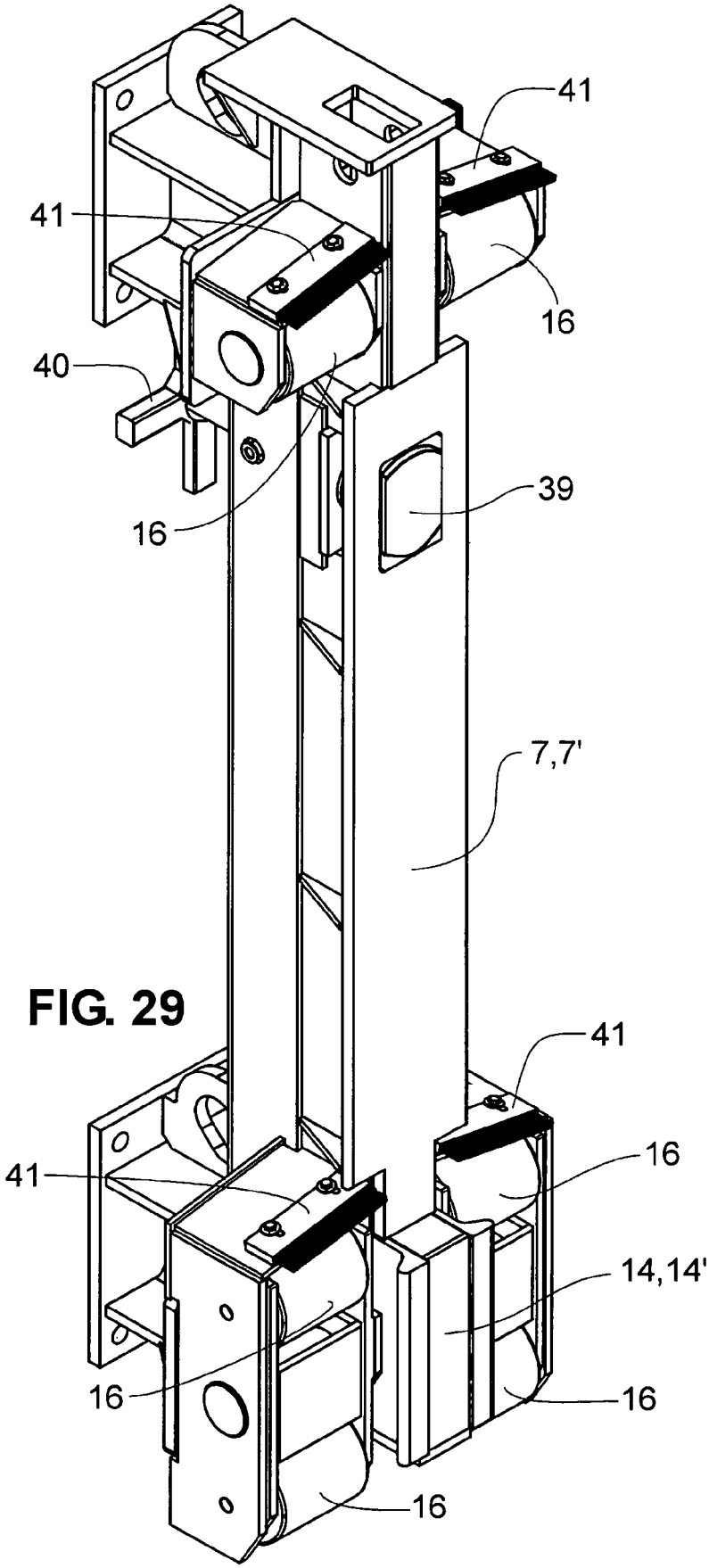
FIG. 29 shows a view corresponding to FIG. 28, showing a movable guide element in a second position.

FIG. 1 shows at the front left-hand support 2 that the guide passage 13 for the left-hand carriage 7 is enlarged in the lower portion approximately over the height of the carriage 7. That enlarged region comprises widening openings produced by removal of the edge bars 15 in the lower region. The opening or the enlarged region is denoted by reference 20 and shown in detail in FIG. 29 illustrating a view of the inside of the support 2. FIG. 21 further shows a section through the lower portion of the upper and outer support 2 and a plan view of the lower and inner support 2'. It can be seen here that the edge bars 15' ensure the positively locking engagement between the dovetail-shaped guide rail 14' of the carriage 7' and the inner support 2'. In regard to the outer support 2, the positively locking engagement is removed in the illustrated lower enlarged region 20 of the guide passage 13, because of the absence of the edge bars 15. The configuration of the edge bars 15 above the section plane is indicated in broken lines in FIG. 21. A guide rail 14, which is inserted into the guide passage 13, of a carriage 7 (see FIG. 10) is consequently guided in the upper region by the edge bars 15 but in the enlarged region 20 (FIG. 21) of the guide passage 13 it can be simply removed from the guide passage 13 towards the interior of the trench. After release of the screw means and removal of the spreading tubes 8 between the carriages 7 of the spreading frame 3 all components of the spreading frame 3 can be removed from the trench. During removal of the spreading frame 3 between the outer supports 2 the support frame 1' is held at a given height by an abutment and arrested there (see FIG. 16). After the lower spreading frame 3 is removed the abutment is removed and the support frame 1' further lowered (see FIG. 17).

Figure 18:
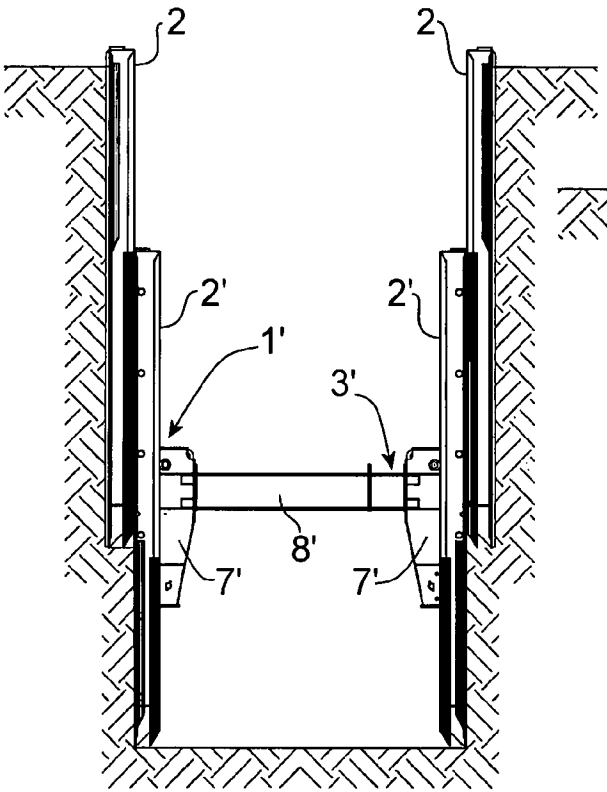
Figure 17:
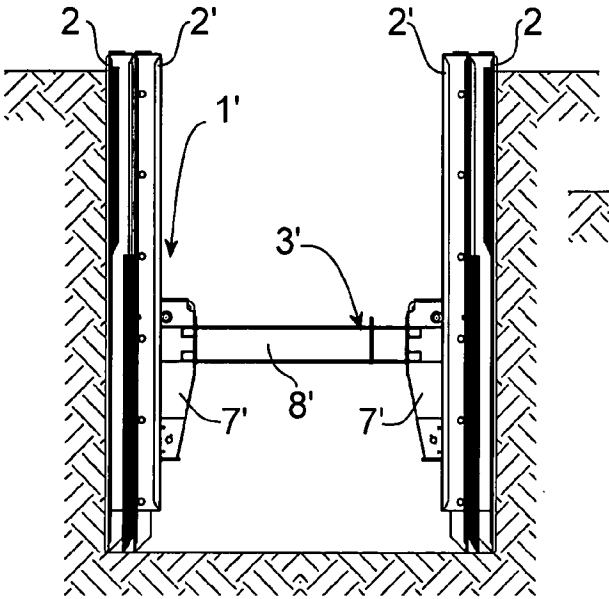

Now a shoring array of the second shoring device comprising two support frames 1' and arranged therebetween outer and inner shoring panels can be lowered as the trench is further continuously dug (see FIG. 18). The lateral pressure loads of the ground or earth are still carried by the displaceable spreading frame 3' between the inner supports 2'. As soon as the inner support frames 1' are lowered sufficiently far the spreading frame 3 which was previously removed beneath the supports 2' between the supports 2 can be inserted again from above between the supports 2 (see FIG. 19). In a further lowering movement of the lower supports 2' the earth loads acting on the upper supports 2 are then again carried by the spreading frame 3 disposed therebetween. The spreading frame 3' carries the earth loads acting on the lower supports 2'.

In that way, an inner support pair 2' is disposed between the outer supports 2 while the lateral earth loads acting on the outer supports 2 are continuously securely carried and, starting from the floor of the trench, after installation of the outer supports 2 (see FIG. 17), the second shoring device which is supported by the inner supports 2' is lowered to a very much greater depth in the trench.

Figure 20:
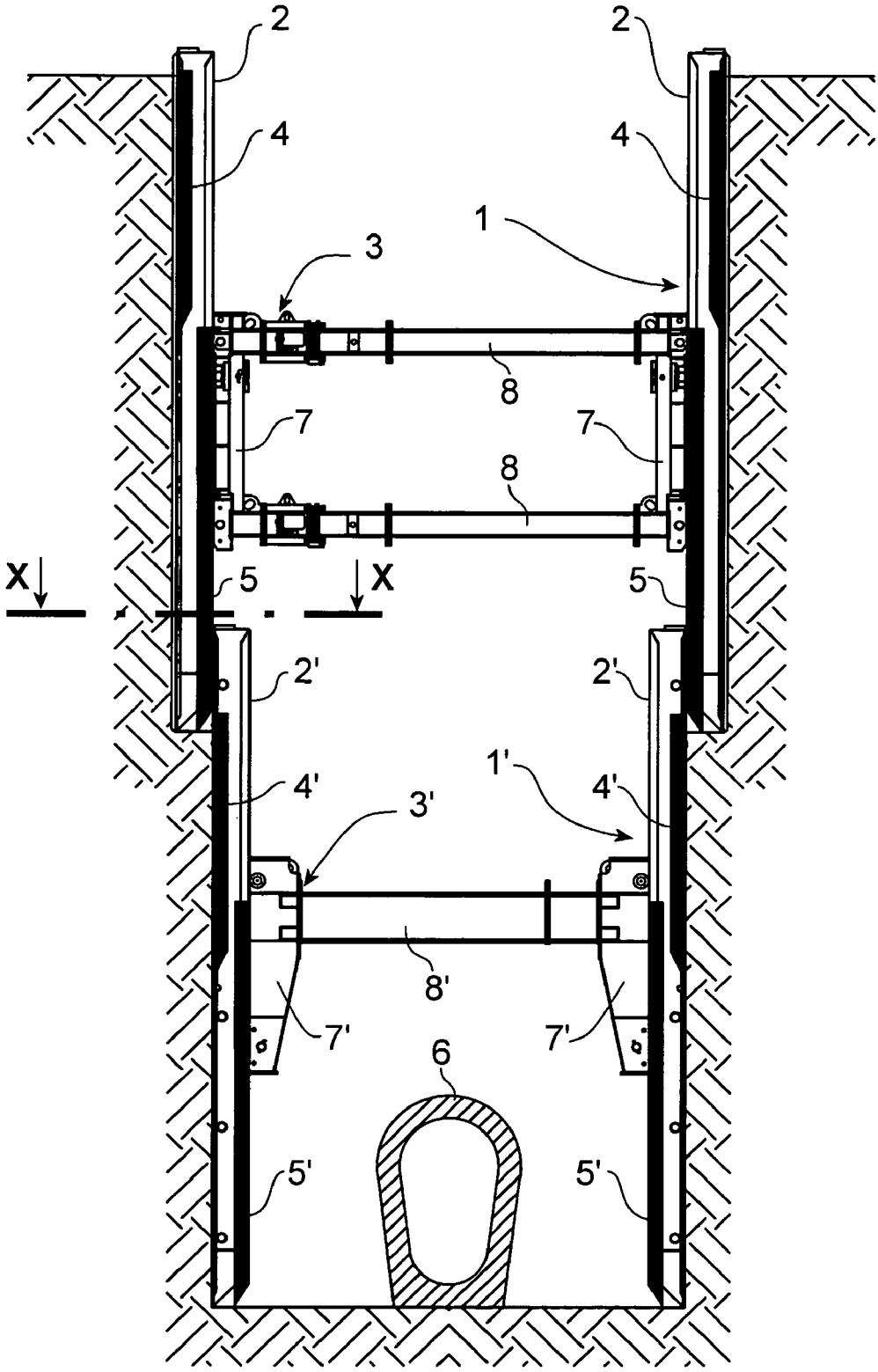

FIG. 20 shows the shoring device according to the system described herein in its installed condition. Illustrated here are the outer shoring panels 4 between the upper supports 2 and 4' between the lower supports 2'. In addition the inner shoring panels 5 can be seen in the receiving passages of the upper supports 2 and the inner shoring panels 5' in the receiving passages of the lower supports 2'. The forces acting laterally on the shoring panels 4', 5' of the lower shoring device are not substantially higher than the forces acting on the shoring panels 4, 5 of the upper shoring device. The vertical load which increases due to the greater depth of installation leads at the same time to a rise in the frictional forces acting in the earth. The frictional force counteracts displacement of the earth in the direction of the trench center. Consequently the high vertical pressure forces acting at a great depth are not transmitted to a major extent in a lateral direction to the shoring panels 4', 5'.

The system described herein however is not limited to the described shoring devices with inner and outer shoring panels extending in the supports, but can also advantageously be used in shoring devices in which only one shoring panel is guided between two successive supports.

The shoring array of the outer shoring device and the shoring array of the inner shoring device are of the same length. In that way a plurality of outer and inner shoring devices can be joined in succession in transition-free fashion in the longitudinal direction of the trench.

FIG. 21 shows the supports at the left-hand side of the FIG. 20 trench, as the view on line x-x. It can be seen here that the support frames 1, 1' of both sides are equipped with shoring panels 4, 5, 4', 5'. In other words the illustrated supports 2, 2' join together two shoring arrays, the length of which is defined by the length of the shoring panels 4, 5, 4', 5'.

It can be seen from FIG. 21 that the guide rail 14' of the carriage 3' is accommodated in the guide passage 13' of the inner support 2'. In contrast, the guide leg 19 at the outside of the inner support 2' engages into the guide passage 13 of the outer support 2 and ensures that the inner support 2' cannot tip over in the longitudinal direction of the trench during installation.

As can be seen from FIG. 20 the guide rail of the upper spreading frame 3 engages into the guide passage, which is open towards the interior of the trench, above the inner supports 2'.

As mentioned hereinbefore it is advantageous if the spreading frame 3' is spread between the inner supports 2' after insertion of the inner support frame 1' between the supports 2 of the outer support frame 1 and prior to removal of the spreading frame 3 between the outer supports 2. In a similar fashion it is appropriate, after re-insertion of the spreading frame 3, during the lowering movement of the lower supports 2', for that re-inserted spreading frame 3 to be laterally spread so that it bears in force-locking relationship against the outer supports 2. In that way any movement of the outer supports 2 towards the center of the trench is avoided during installation and while the inner support frame 1' passes between the outer supports 2.

Figure 22:
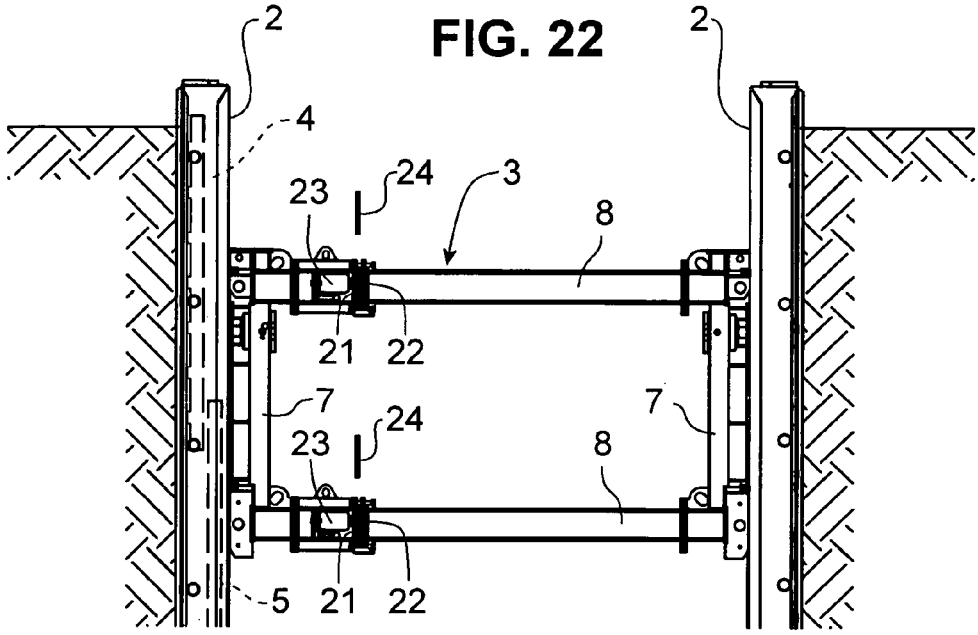
FIG. 22 shows a diagrammatic front view of a spreading frame according to the system described herein with hydraulic spreading device.

FIG. 22 diagrammatically shows a spreading device permitting the spreading movement. It can be seen that the left-hand carriage 7 of the spreading frame 3 has a hydraulic spreading device. The spreading device is in the region of two connecting flanges 21, 22 arranged on the one hand on the carriage 7 and on the other hand at an end of the spreading tube 7. Each hydraulic spreading device includes a hydraulic cylinder 23. In the illustrated spreading frame 3, hydraulic cylinders 23 are provided both in the region of the lower spreading tube 8 and also in the region of the upper spreading tube 8. To spread the frame, the screw connection of the connecting flange 21 on the carriage 7 to the connecting flange 22 on the spreading tube 8 can be released. The hydraulic cylinder 23 is then pressurized. Preferably the upper hydraulic cylinder 23 and the lower hydraulic cylinder 23 are pressurized synchronously with the same pressure. After the spreading frame 3 is spread to the desired width a locking plate 24 is inserted between the spread connecting flanges 21, 22.

Figure 23:
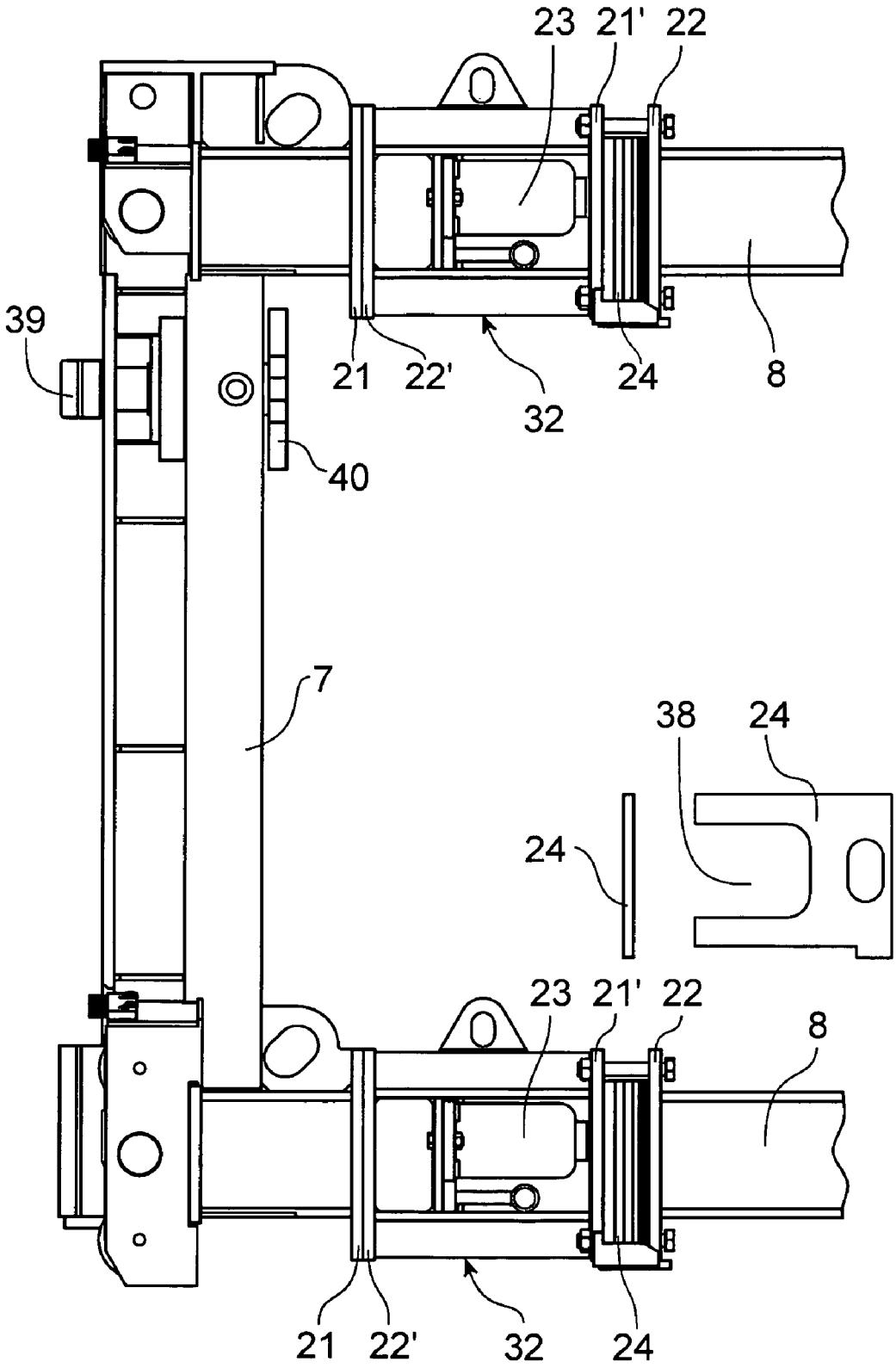
FIG. 23 shows a detailed front view of the support frame with hydraulic spreading device shown in FIG. 22.

As can be seen from FIG. 23, a plurality of locking plates 24 are inserted between two adjacent connecting flanges 21' and 22. As an alternative to the plurality of locking plates 24, it is also possible to use locking plates of differing thicknesses. Above the lower connecting flange 21', 22 FIG. 23 shows an isolated locking plate 24 both as a side view on its narrow side and also as a plan view, turned through 90°, on its wide side. In addition here, as described hereinafter, the connecting flange 21 associated with the carriage 7 is a component part of an additional element which has the hydraulic cylinder 23. The locking plates 24 are so designed that they can be pushed through between screws by which the adjacent connecting flanges 21' and 22 are screwed together. In addition at its center the locking plate 24 has an elongate opening 38 which permits the piston rod 36 to pass therethrough (see FIG. 25).

After spreading and insertion of the locking plate the connection comprising the connecting flanges 21', 22 and the locking plate 24 is screwed together again so that the spreading frame 3 still has a high level of flexural stiffness. The locking plates 24 are available in various thicknesses so that it is possible to select the respective thickness which corresponds to the maximum spreading by the spreading device.

The procedure can be reversed for removal of the spreading frame 3 between the supports 2. Firstly a screw connection can be released and then a certain pressure applied to the hydraulic cylinders 23. As a result the hydraulic cylinder 23 takes over the pressure from the locking plate 24 inserted between the connecting flanges 21', 22. A locking plate 24 is then removed. When then the hydraulic pressure is released from the hydraulic cylinders 23 the spreading tubes 28 are disposed with wide clearance between the two lateral carriages 7. The spreading tubes 8 can be removed after release of the screw connection of the connecting flanges on the right-hand side. The carriages 7 can then be removed from the guide passages 13 of the supports 2 through the enlarged region 20 (see FIGS. 1 and 26) in the lower region of the supports 2.

As mentioned above the spreading carriage 3' of the inner shoring device also has a similar spreading device.

Figure 24:
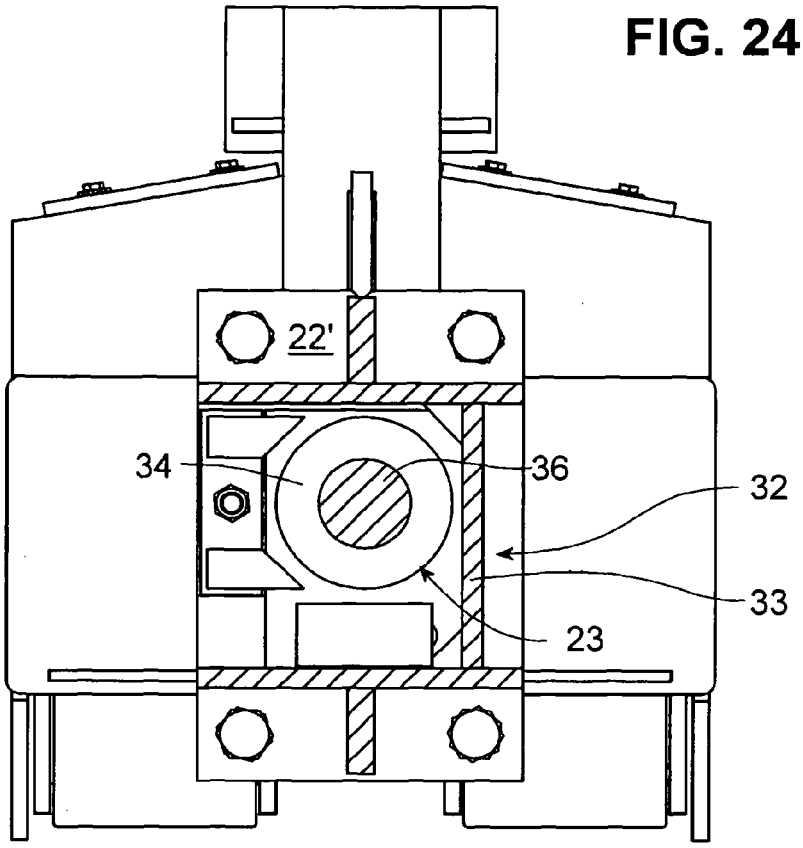
FIG. 24 shows an enlarged side view of a spreading device.
Figure 25:
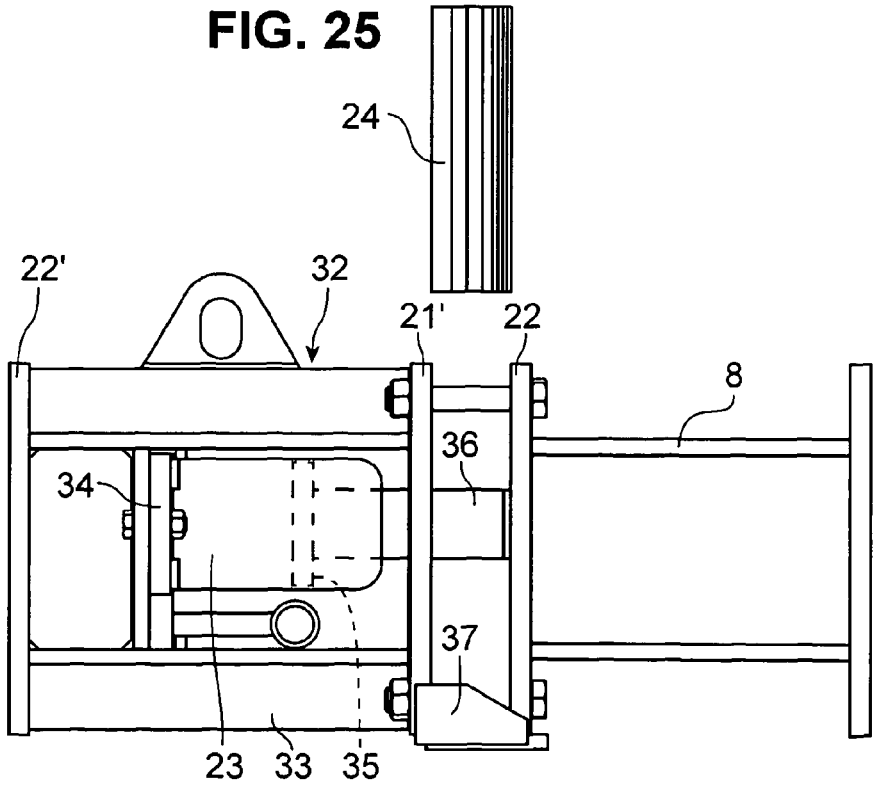
FIG. 25 shows an enlarged front view of the spreading device.
Figure 26:
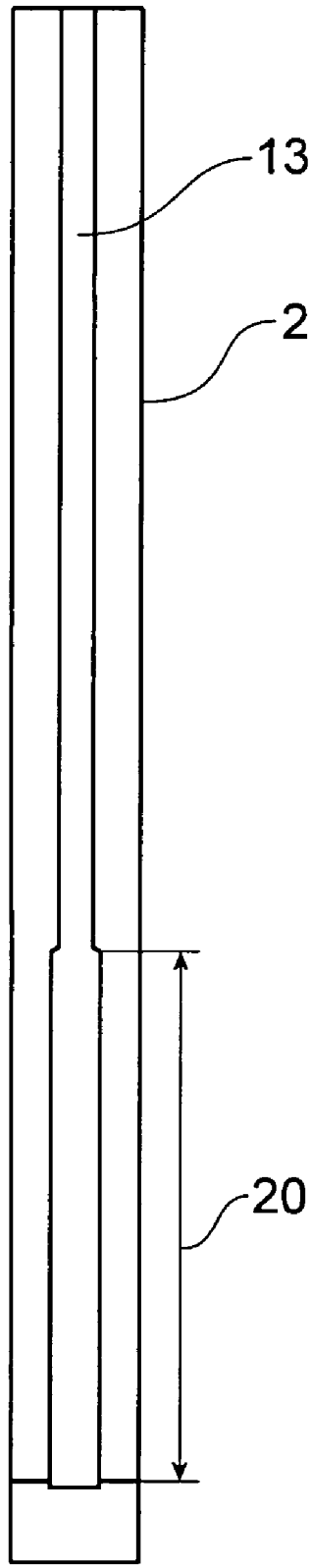
FIG. 26 shows a plan view of the inside of a support.

The spreading device diagrammatically shown in FIG. 22 is illustrated in detail in FIGS. 23 through 25. As shown in FIG. 23 the spreading devices with hydraulic cylinders can form additional elements 32 which are screwed between the connecting flange 21 of a carriage 7 and the opposite connecting flange 22 of the spreading tube 8 and have two corresponding connecting flanges. The connecting flange 21' of the additional element 32, that faces the connecting flange 22 of the spreading tube 8, then forms the connecting flange 21' which is associated with the carriage 7 and which can be pushed away from the connecting flange 22 of the spreading tube 8.

FIGS. 24 and 25 show one of the above-mentioned additional elements 32 on an enlarged scale. In that respect the view of the additional element 32 in FIG. 24 shows a part of the connecting flange 21 which is at the front in cut-away form so that the hydraulic cylinder 23 is visible. For the same reason a part of the side wall, visible in FIG. 25, of the hollow box profile 33 is cut away. In addition FIG. 25 shows the left-hand end of a spreading tube 8 with connecting flange 22 as well as a locking plate 24.

The additional element 32 is screwed with its left connecting flange 22' against a connecting flange 21 of the carriage 7. With the second connecting flange 21' the additional element 32 is screwed to the corresponding connecting flange 22 of the spreading tube 8. Between the two connecting flanges 21' and 22' of the additional element 32 is a hollow box profile 33 accommodating a hydraulic cylinder 23. The hydraulic cylinder 23 is welded to the connecting flange 22', with a base plate 34. The hydraulic cylinder 23 has a hydraulically displaceable piston 35 and a piston rod 36 which is connected thereto and the free end of which presses against the connecting flange 22 of the spreading tube 8. Spreading of the spreading device can be seen in particular from FIG. 25. When the hydraulic cylinder 23 is pressurized the piston 35 presses the piston rod 36 against the connecting flange 22 of the spreading tube 8 so that a gap is produced between same and the opposite connecting flange 21' of the spreading tube 8. It is possible to insert into that gap the locking plate 24 which projects between screws inserted into the bores in the connecting flanges 21', 22. Thereafter the pressure is released from the hydraulic cylinder 23 and the two connecting flanges 21', 22 screwed to the locking plate 24 disposed therebetween.

It can be seen from FIGS. 24 and 25 that a guide profile 37 is welded in position in the lower region of the connecting flange 21' of the additional element 32. It is U-shaped in the view shown in FIG. 24 and embraces the lower edge of the connecting flange 21' in substantially flush relationship. The guide profile 37 ensures that, upon displacement with the released screw connection of the mutually opposite connecting flanges 22, 21', they remain in mutually aligned relationship and can be screwed together again following the displacement.

Figure 27:
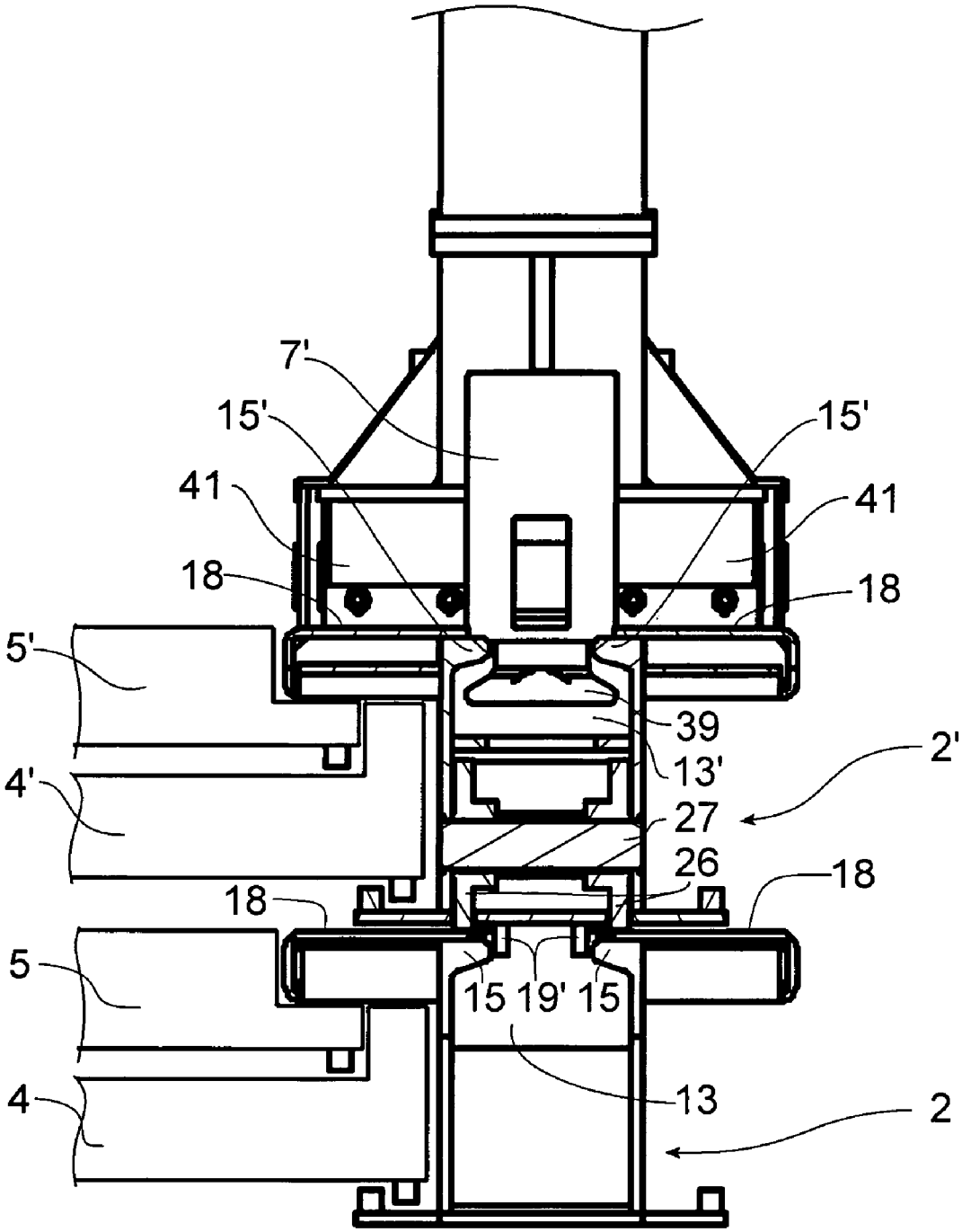
FIG. 27 shows a plan view of the left-hand supports of a further embodiment of the shoring device according to the system described herein in the fully installed condition.

FIG. 27 shows a plan view of further embodiments of the two left-hand supports of an installed shoring device according to the system described herein with the shoring panels 4, 4', 5, 5' accommodated therein, at one side of the support. At the other support side the passages for receiving the edges of the shoring panels are empty.

In this embodiment, as a departure from the view in FIG. 21, the outer support 2 and the inner support 2' are of different configurations from each other. With such an embodiment care is to be taken to ensure that the supports 2, 2' are installed in the correct position at the outside or inside respectively. Each of the supports 2, 2' can be optimally adapted to its function by virtue of the differing configuration thereof.

The inner support 2' has at regular spacings horizontal shafts 27 which are fixed near the outside of the support 2' in the hollow box profile forming the support 2'. Arranged on the horizontal shafts 27 are rotatable rollers 26 which roll on the inner portions of the support flanges 18 of the outer support 2. That ensures easy displacement of the supports 2' of the inner support frame 1' between the outer supports 2. In that case the periphery of the rollers 26 extends through elongate openings in the outside wall of the inner support 2' and projects by some millimeters beyond that outside wall. The inner support 2' alone has a pair of guide legs 19'. The two guide legs 19' are very short and do not generate any resistance when the support is lowered into the ground. The guide legs can be omitted on the outer support 2 in the illustrated embodiment because the outer support 2 generally does not have to be guided along a further outwardly disposed support.

Figure 28:
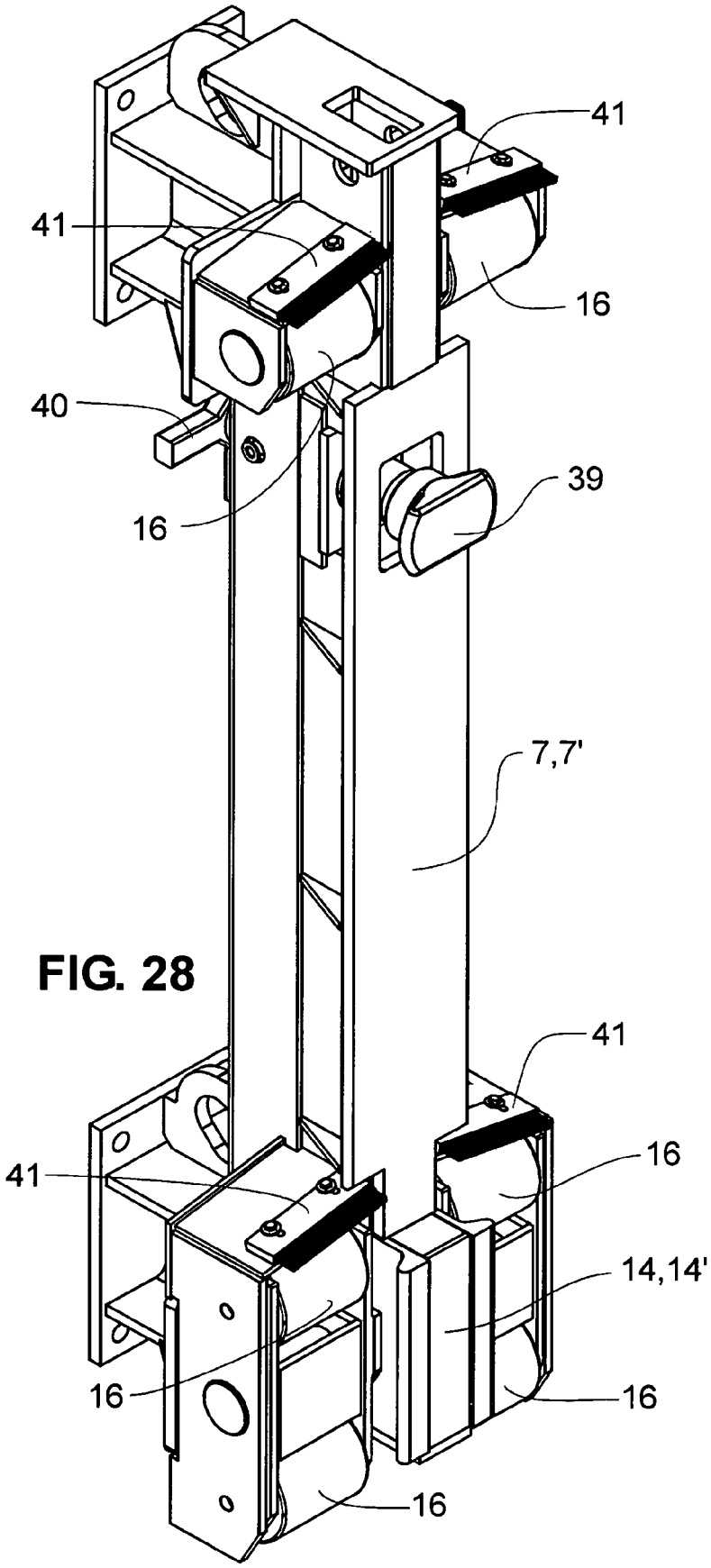
FIG. 28 shows a diagrammatic view of the outside, directed towards the linear guide, of a carriage of a spreading frame of the shoring device of the system described herein.

In the embodiment of FIG. 27 the supports and the carriages 7' have further characteristic features. The carriage 7' is shown in FIGS. 28 and 29. It can be seen in that respect that the guide rail 14' extends only over a short lengthwise portion in the lower region of the carriage 7', in which the rollers 16 are arranged. In the upper region, just below the upper rollers, it is possible to see a guide element 39 which can be moved from a first position shown in FIG. 28 into a second position shown in FIG. 29.

In the first position shown in FIG. 28 the movable guide element 39 is in the guide passage 13' when the rollers 26 bear against the support flange 18 of the support 2'. The movable guide element 39 can be manually moved into the second position shown in FIG. 29 by means of a handling means 40. In that case the movable guide element 39 is firstly rotated so that it no longer engages behind the edge bars 15' of the guide passage 13. The movable guide element 39 is then withdrawn from the guide passage 13'.

That movable guide element permits removal of the carriage from the guide passage 13' when the carriage has reached the support entirely at its bottom.

Figure 30:
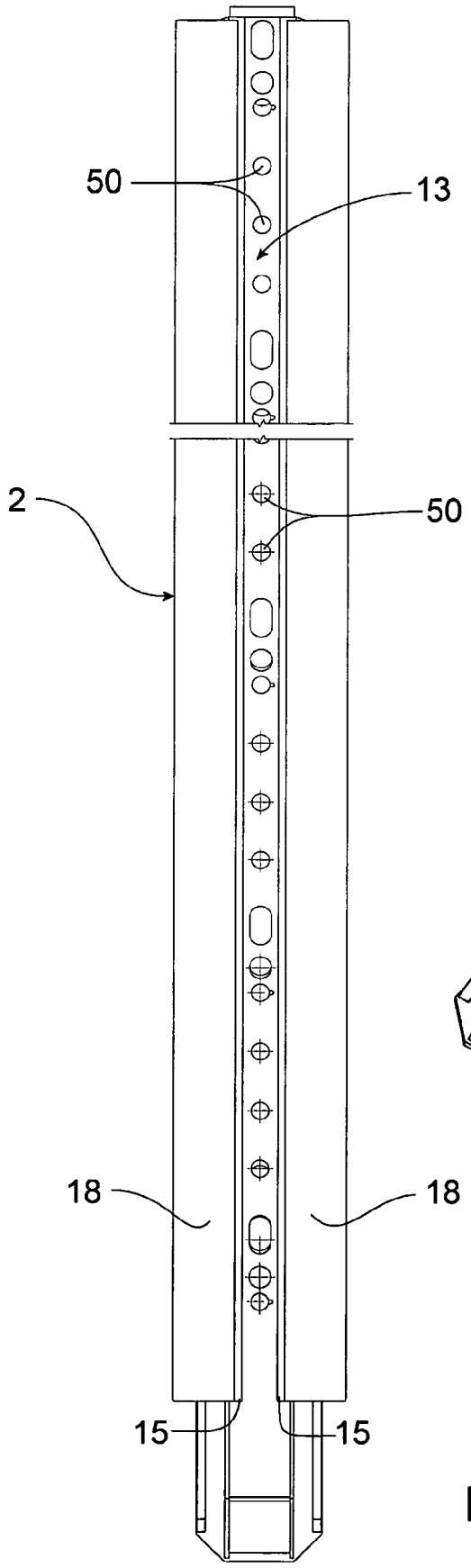
FIG. 30 shows a view corresponding to FIG. 26 of the inside of an outer support.
Figure 31:
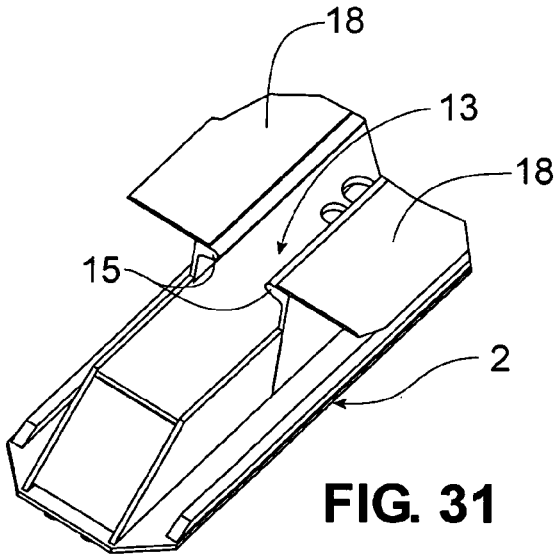
FIG. 31 shows an enlarged diagrammatic view of the lower end of the support of FIG. 30.
Figure 32:
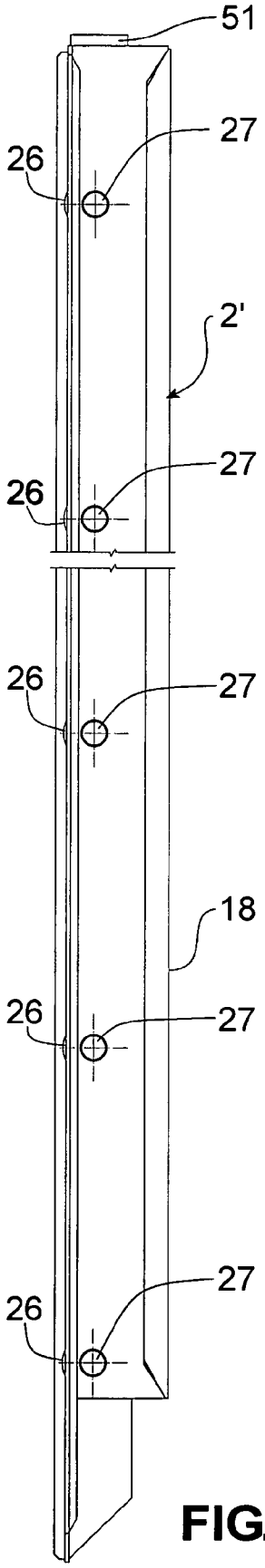
FIG. 32 shows a side view of an inner support.
Figure 33:
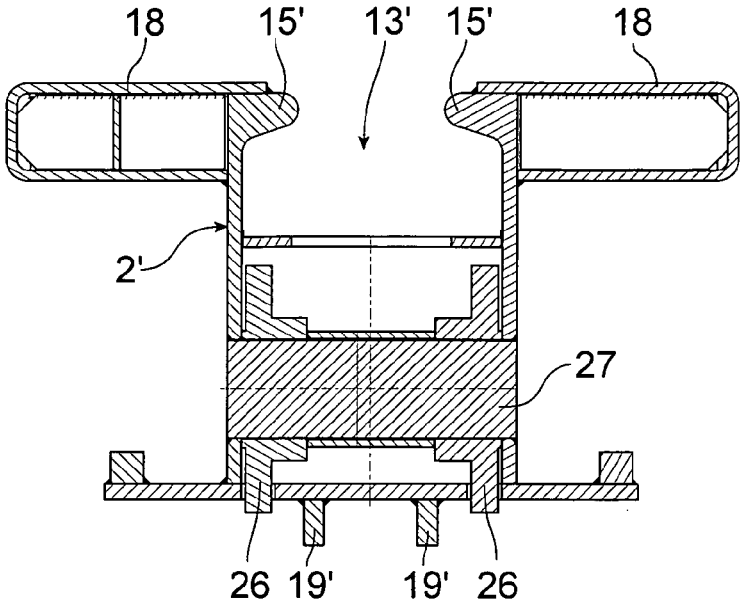
FIG. 33 shows a cross-sectional view of the inner support of FIG. 32.
Figure 34:
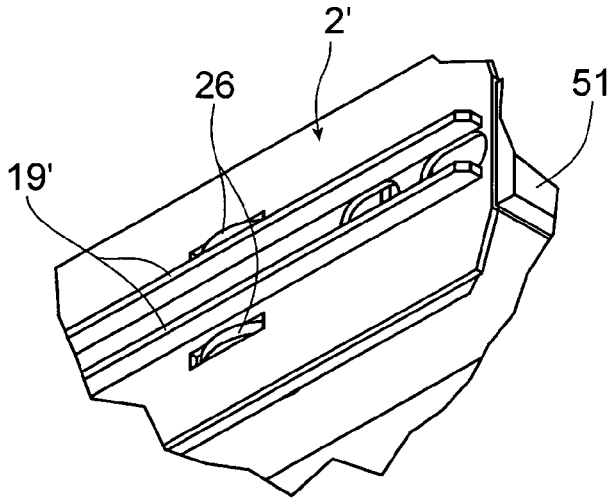
FIG. 34 shows an enlarged diagrammatic view of the upper end of the support of FIGS. 32 and 33.

FIGS. 30 and 31 show an outer support 2 as a plan view on its side towards the interior of the trench and as a diagrammatic detail view illustrating the lower end. FIGS. 32 through 34 show an inner support 2' as a side view, a cross-sectional view and a diagrammatic detail view illustrating the upper end.

It can be seen in relation to both supports 2, 2' that the support flanges 18 end at a spacing of about 30 cm above the lower end of the support 2, 2'. When the carriage 7' (see FIGS. 28 and 29) is displaced entirely downwardly the short guide rail 14' of the carriage 7' is in the lower portion of the support 2, 2' without support flanges 18. That portion forms the enlarged region of the guide passage 13, 13' from which the short guide rail 14 can be moved inwardly and even out in the longitudinal direction of the trench. It will be noted however that this is not readily possible as long as the movable guide element 39 engages behind the edge bars 15, 15' of the guide passage 13, 13'. To release a carriage 7, 7' from the guide passage 13, 13' completely and for example to lay it on the floor of the trench the movable guide element 39 is moved into the retracted position of FIG. 29. When then the carriage 7' is entirely downwardly at the base of the trench and is at the lower region of the support 2 or 2' it can be placed in a horizontal position on the floor of the trench. Here the carriage can be taken apart and removed.

FIGS. 28 and 29 show further details of the carriage 7'. Thus for example it is possible to see above the upper and lower rollers 16 scraper brushes 41 which avoid excessive soiling of the rollers 26.

FIGS. 32 and 33 also show the horizontal shafts 27 arranged at regular spacings at the outside of the inner supports 2' and carrying the rollers 26 which roll against the support flanges 18 of the outer supports 2 (see FIG. 27). The views in FIGS. 30 and 31 show that the support flanges 18 of the outer supports 2 form the running faces for the rollers 26 of the inner supports 2'.

It can also be seen that apertures 50 are arranged at regular spacings in the hollow box profile forming the outer supports 2. The apertures 50 serve on the one hand to receive an abutment. The abutment prevents the carriage 7 being displaced excessively downwardly and prevents its short guide rail 14 from unintentionally coming out of the lower region in which the support flanges 18 are removed.

In addition the apertures 50 serve to receive a pressing device described hereinafter which permits the inner supports 2' to be pressed into the ground when they are already beneath a spreading frame mounted between the outer supports 2.

Figure 19:
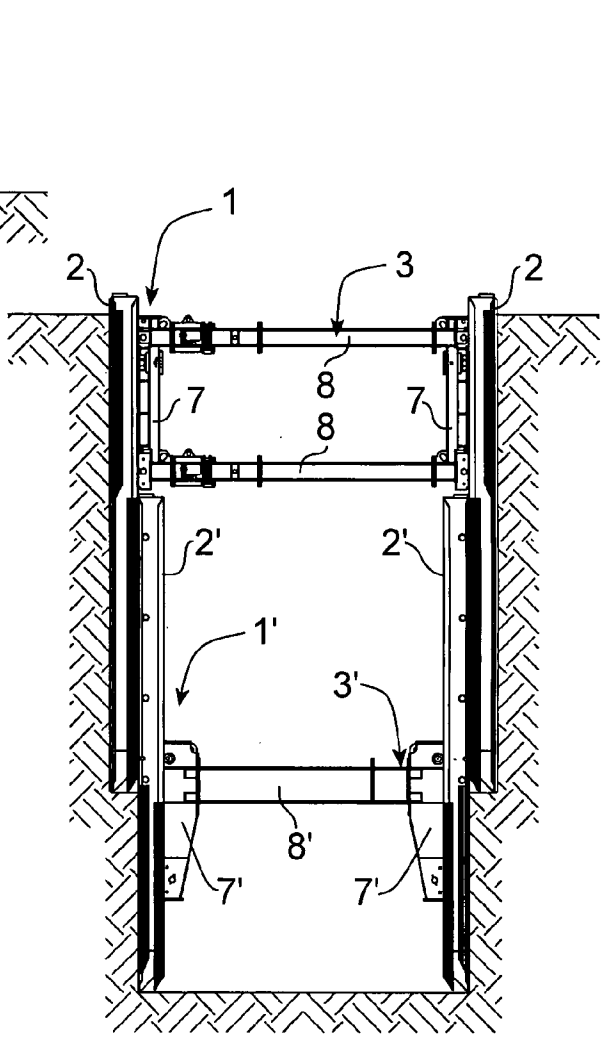

As can be seen from FIGS. 19 and 20, when the inner supports 2' are passed through the outer supports 2 and upon further lowering movement after insertion of the spreading frame 3 between the outer supports, the result is an installation situation in which the head region of the inner supports 2' is no longer freely accessible. The spreading frame 3 is above the head region of the supports 2'. It is difficult for that reason to exert sufficient pressing forces on the inner supports 2' with an excavator bucket, to move them downwardly when the trench is further dug out.

FIGS. 35 through 38 show a pressing device 42 which, in conjunction with the outer support 2 shown in FIG. 10, facilitates further downward movement of the inner support 2'. The pressing device 42 has a box-shaped steel housing 43. Two mutually parallel projections 44 are arranged at each of the two narrow sides of the steel housing 43. The housing 43 is provided at one side with a coupling portion 45 of a quick-change coupling. The complementary coupling portion 46 is mounted to the boom 47 of an excavator (see FIG. 38). The coupling portions 45, 46 of the quick-change coupling make it possible for the pressing device 42 to be fixed to the boom 47 within a few seconds.

Figure 35:
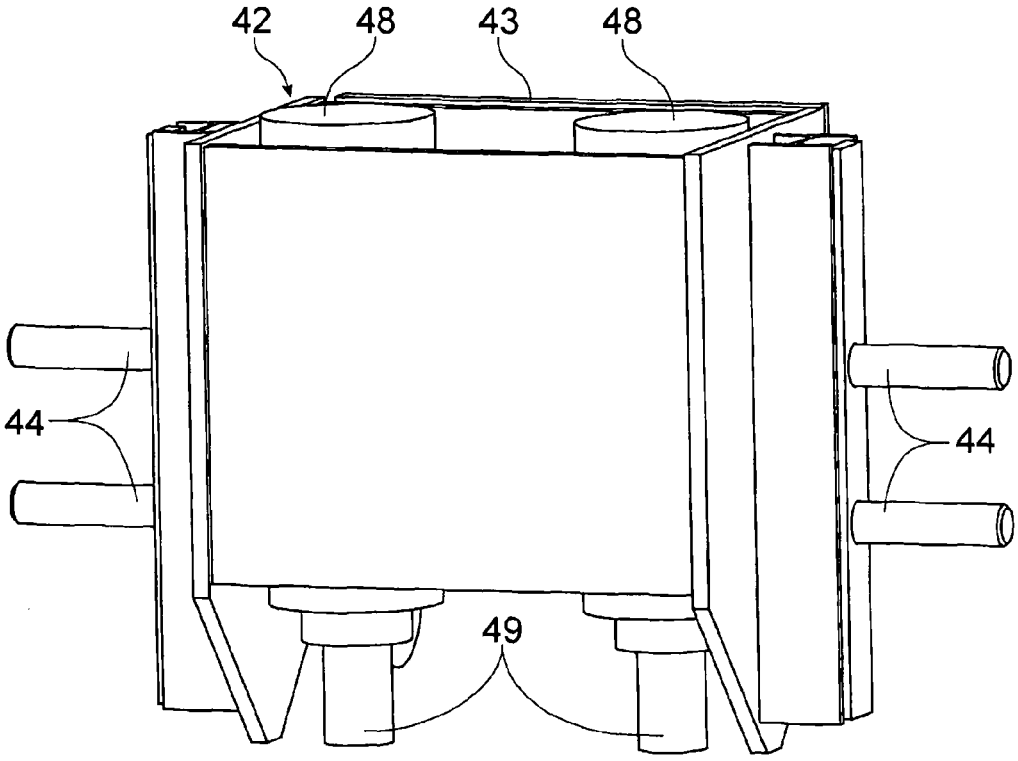
FIG. 35 shows a diagrammatic front view of a pressing device.
Figure 36:
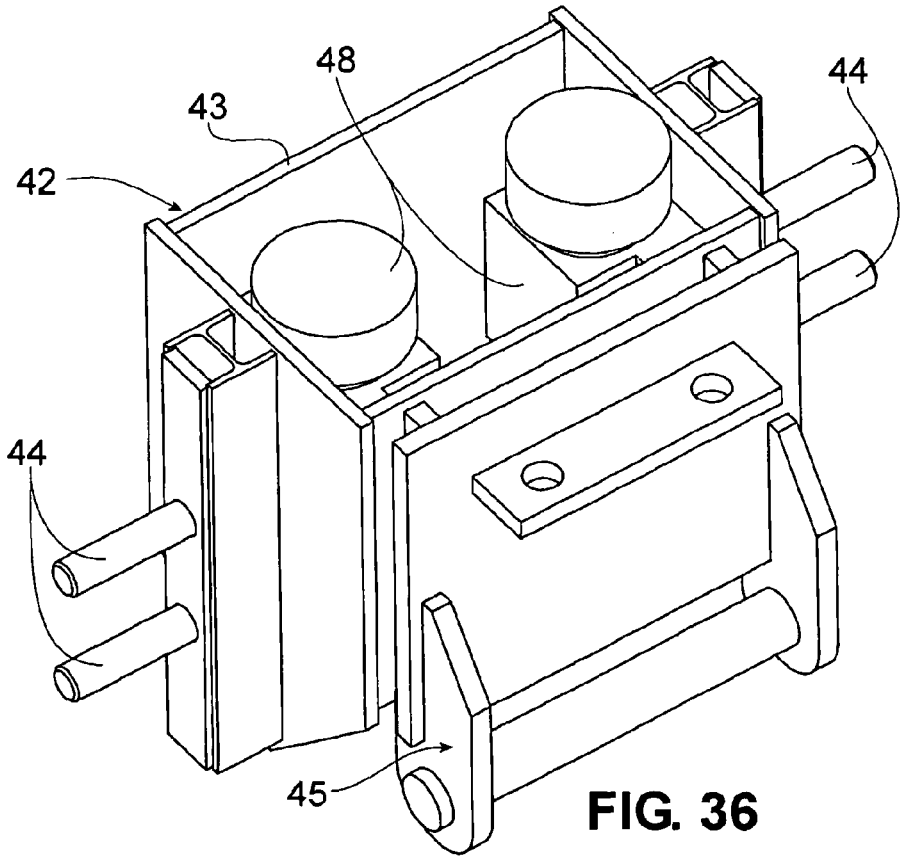
FIG. 36 shows a diagrammatic rear view of the pressing device of FIG. 35.

As FIGS. 35 and 36 further show, disposed within the housing 43 of the pressing device 42 are two hydraulic pressing cylinders 48 with which two pressing pistons 49 can generate a pressing force downwardly. The quick-change coupling also includes coupling members (not shown) which connect the hydraulic circuit of the excavator to the hydraulic pressing cylinders 48 of the pressing device 42.

The projections 44 co-operate with apertures 50 provided at the spacing of the projections 44 in the guide passage 13 of the support 2 (see FIG. 28). In that respect the apertures 50 which are distributed regularly over the first outer linear guide form first holding elements and the projections 44 of the pressing device 42, which can be fitted thereinto, form second holding elements co-operating therewith.

Figure 37:
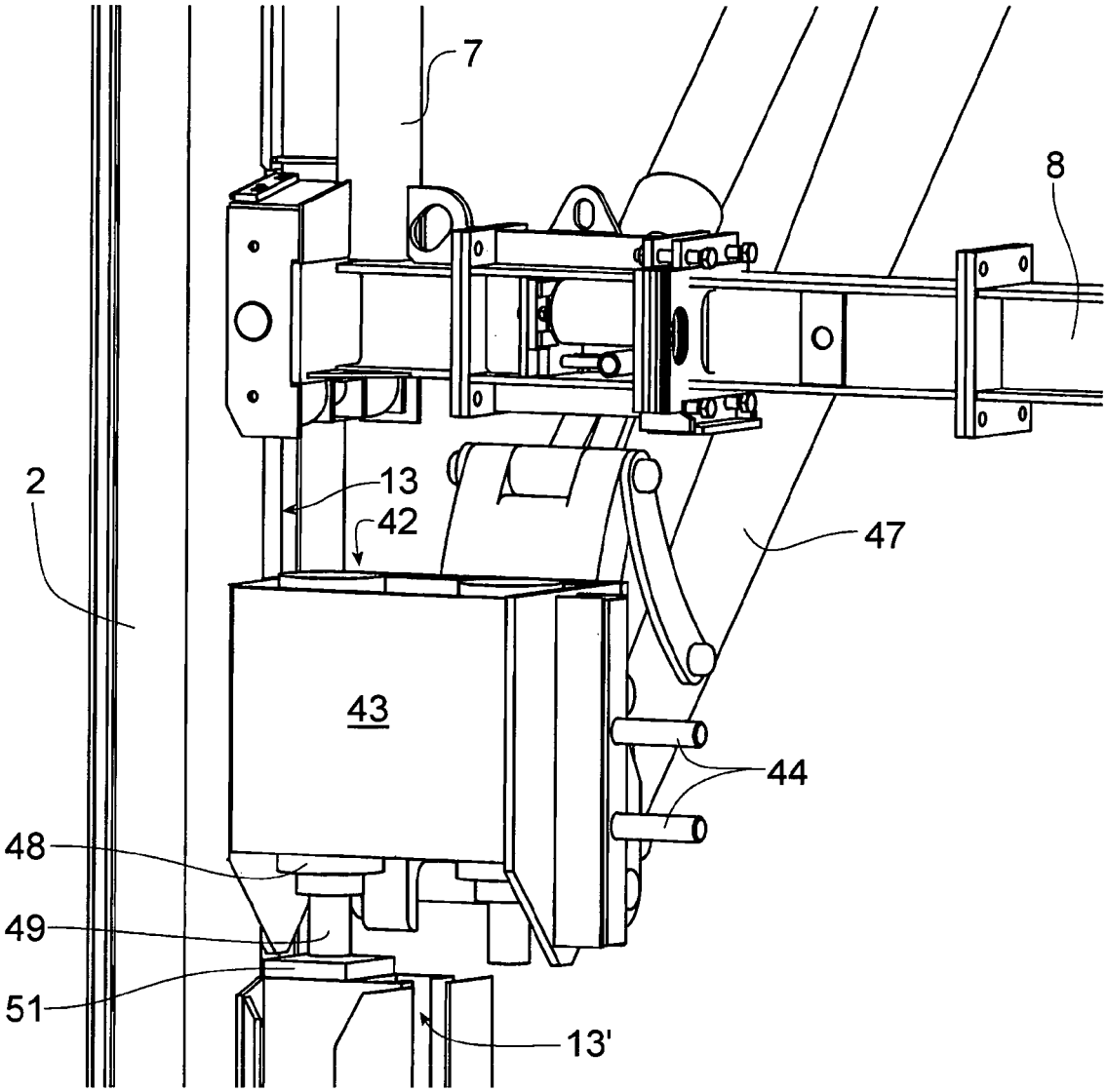
FIG. 37 shows a diagrammatic front view of the pressing device of FIGS. 35 and 36 on a pair of supports.
Figure 38:
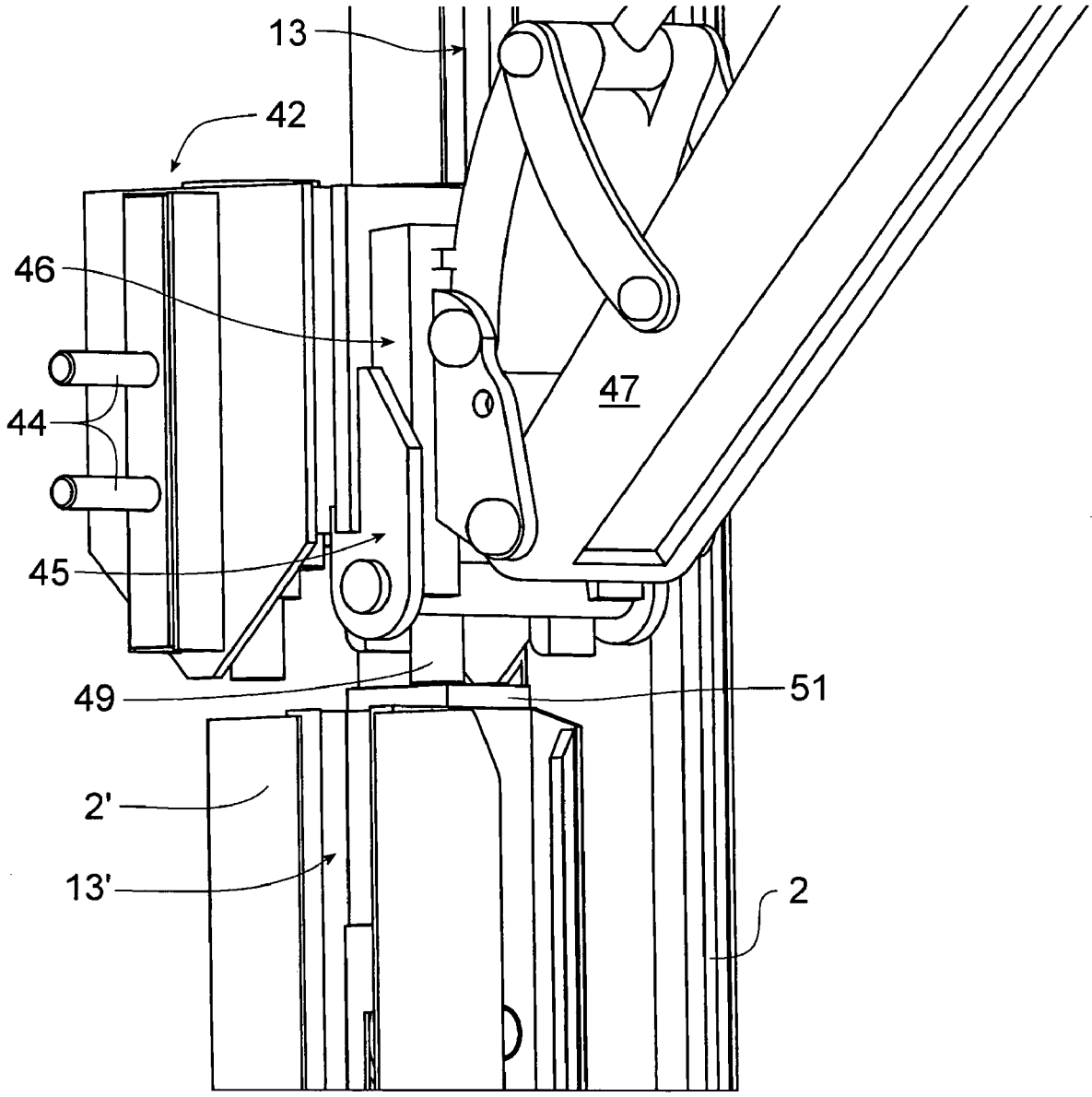
FIG. 38 shows a diagrammatic rear view of the pressing device of FIG. 37.

The use of the pressing device 42 is shown in particular in FIGS. 37 and 38.

An outer support 2 and an inner support 2' can be seen in both of these Figures. Disposed above the head end of the inner support 2' is the spreading frame 3 arranged between the pair of outer supports 2. FIGS. 37 and 38 show in particular the lower ends of the carriages 7, which are held by an abutment (not shown) at the outer supports 2 at a certain spacing from the head end of the inner supports 2'.

The pressing device 42 is connected to the boom 47 of an excavator by way of the two coupling portions 45, 46. The boom 47 holds the pressing device in such a way that the two projections 44 at one side of the housing 43 are inserted into two apertures 50 within the guide passage 13 of the outer rail 2 (see FIG. 28). The housing 43 of the pressing device 42 is connected to the outer support 2 in positively locking relationship by way of the two projections 44.

At least one pressing cylinder 48 is activated by way of the hydraulic lines of the excavator in such a way that the pressing piston 49 presses against a head plate 51 of the inner support 2'. The pressing force of the pressing piston 49 drives the lower end of the inner support 2' deeper into the dug-out trench.

While, in the above-described embodiments of the system described herein, the supports 1, 1', 2, 2' with the linear guides 13, 13', 14, 14' are separable from the shoring panels 4, 4', 5, 5', the embodiment shown in FIGS. 28 through 31 provides that the supports are fixedly connected to or integrated in the shoring panels. The supports are disposed at the lateral edges of the shoring panels and in relation to this embodiment are referred to as a vertical rail forming the linear guides for the spreading frames. The method according to the invention is operable not only with edge-supported shoring devices but also with center-supported shoring panels suitable for shoring trenches of small depth.

Figure 39:
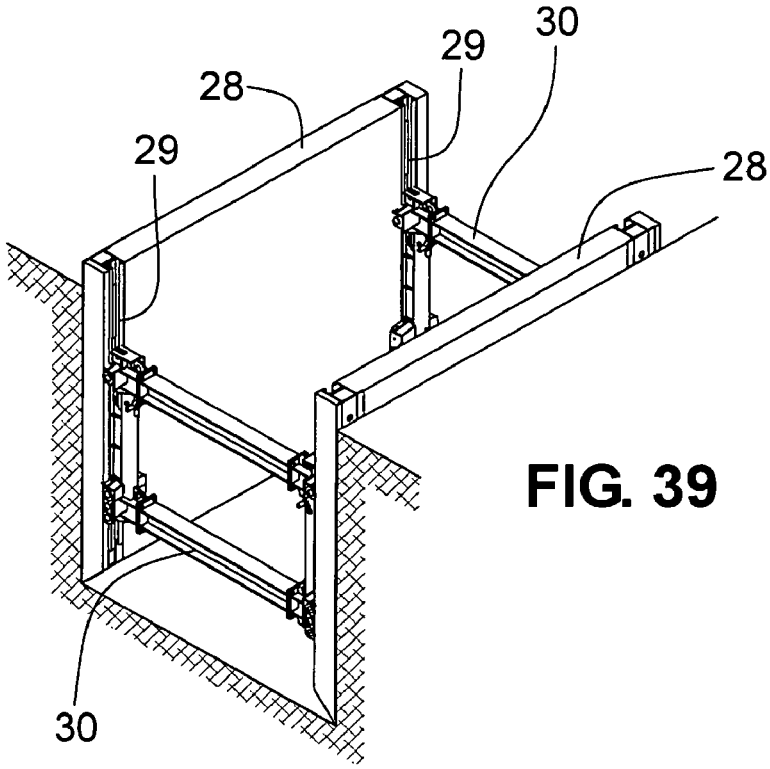
FIG. 39 shows a diagrammatic view of a shoring array with edge-supported shoring panels in the installed condition.

FIG. 39 is a diagrammatic view of a single shoring array, also referred to as a shoring box, comprising two edge-supported shoring panels 28. Each of the shoring panels 28, in the region of its two vertical edges, has guide passages 29. The guide passages 29 are provided in edge profiles of the shoring panels 28 and accommodate guide elements of two flexurally stiff spreading frames 30 guided displaceably in a vertical direction.

Such a shoring device is set up on the ground at the location at which the trench is to be dug and is then lowered into the dug trench during the continuous excavation operation. FIG. 39 shows the shoring box at the end of that installation procedure.

Figure 40:
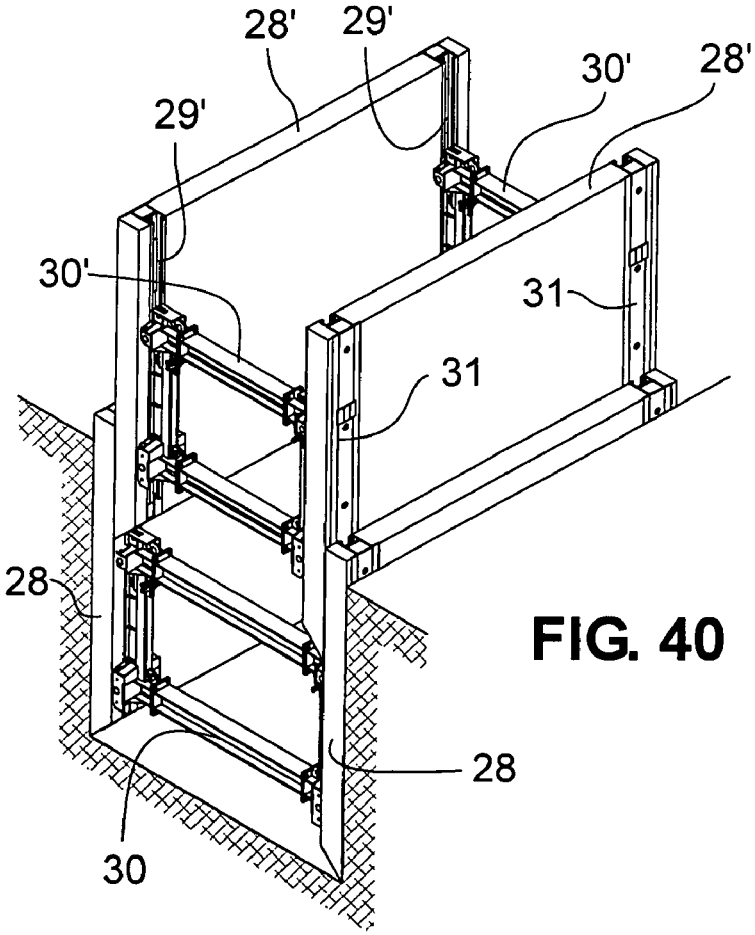
FIG. 40 shows a view corresponding to FIG. 39 of the shoring array with a fitted second inner shoring array.

FIG. 40 shows the insertion of a second shoring box in the first shoring box. Two shoring panels 28, 28' are fitted into the outer shoring panels 28, 28', in which case guide legs 31 at the outsides of the inner shoring panels 28' are guided in the guide passages 29 at the insides of the outer shoring panels 28.

The shoring panels 28' of the inner shoring device are held in the FIG. 40 position by abutments (not shown). The spreading frames 30' are then spread between the inner shoring panels 28', as described above, so that they carry the loads acting from the exterior on the outer shoring panels 28. In that way the spreading frames 30 between the outer shoring panels 28 are relieved of load and can be removed, as described above. For that reason the spreading frame 30 between the outer shoring panels 28 must be removable from the guide passages 29 of the outer shoring panels 28.

Figure 41:
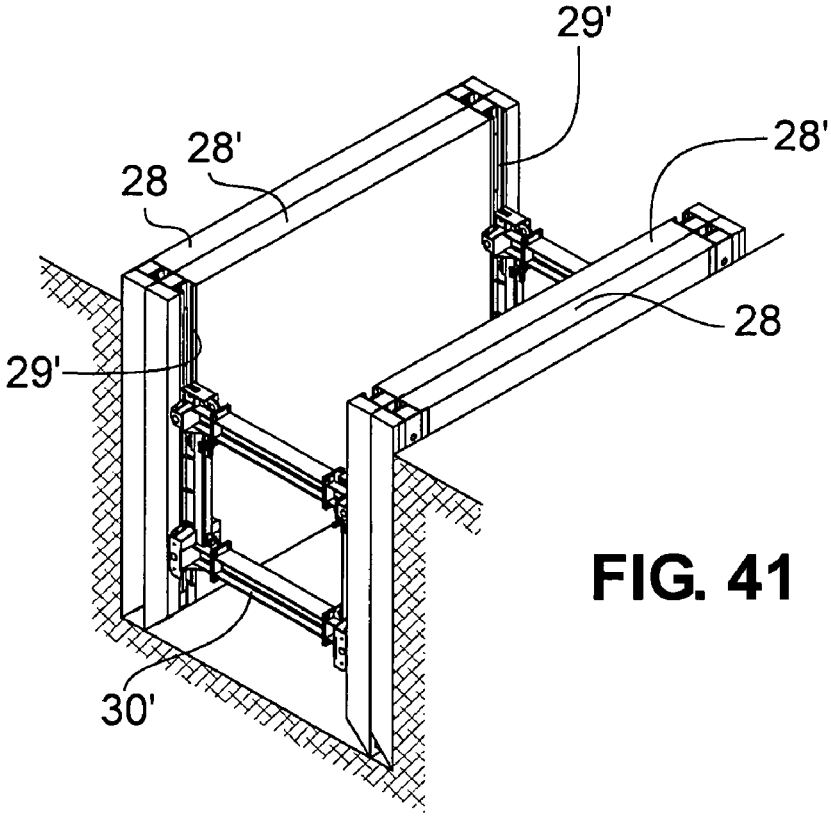
FIG. 41 shows a view corresponding to FIG. 40 of the shoring array with the inner shoring array inserted completely into the first outer shoring array.

As shown in FIG. 41 when the spreading frame is removed between the outer shoring panels 28, the shoring array comprising the inner shoring panels 28' can be lowered completely into the trench. When the trench is further dug out the inner shoring device comprising the shoring panels 28' with the spreading frames 30' therebetween is further lowered. In order to effectively carry the earth loads acting on the upper and outer shoring panels 28, upon further lowering movement of the inner shoring device with the shoring panels 28' the spreading frames 30 are again inserted between the outer shoring panels 20 and spread, as described hereinbefore, to relieve the spreading frames 30' of the load acting on the outer shoring panels 28.

Figure 42:
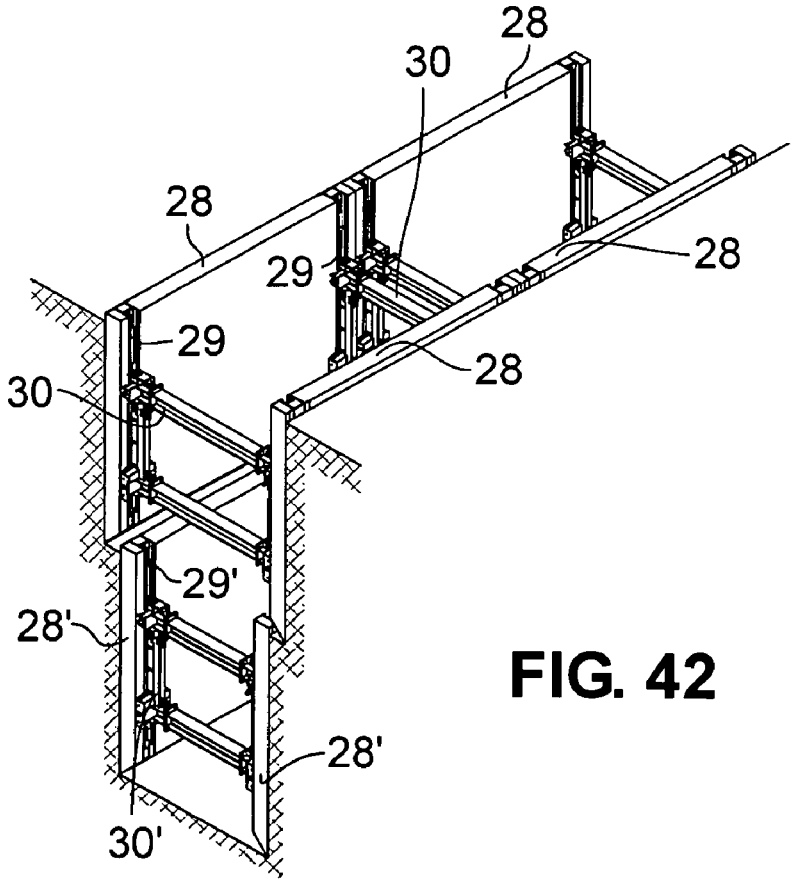
FIG. 42 shows a view corresponding to FIGS. 39 through 41 with the second shoring array installed completely beneath the first shoring array.

Consequently by virtue of the system described herein it is possible to line very large trench depths with simple shoring arrangements such as shoring boxes with edge-supported shoring panels. As shown in FIG. 42 a plurality of such shoring arrays can be joined together in order to provide interruption-free shoring of a trench of relatively great length.

It will be appreciated that, in relation to the shoring boxes with edge-supported shoring panels, it is also possible to use the pressing device 42 for lowering the inner shoring panel 28' between the outer shoring panels 28 when the guide passages 29 have apertures 50 therein, as are shown in FIG. 41 for the outer support 2.

Other embodiments of the invention will be apparent to those skilled in the art from a consideration of the specification or practice of the invention disclosed herein. It is intended that the specification and examples be considered as exemplary only, with the true scope and spirit of the invention being indicated by the following claims.

The invention claimed is:

1. A method of trench shoring, comprising:

inserting at least a first pair of mutually oppositely arranged shoring panels into a trench;

guiding a spreading frame between the two shoring panels in a first pair of linear guides, wherein a respective linear guide of the first pair of linear guides is connected to a respective one of the shoring panels of the first pair of shoring panels;

guiding at least a second pair of mutually oppositely arranged shoring panels between the first pair of shoring panels and inserting the second pair of mutually oppositely arranged shoring panels into the trench;

inserting a second pair of linear guides between the first pair of linear guides;

connecting a respective linear guide of the second pair of linear guides to at least one shoring panel of the second pair of shoring panels and the linear guides of the second pair of linear guides are held at a spacing by the spreading frame;

removing the spreading frame from between the first pair of linear guides; and when the trench is further dug out, lowering the second pair of shoring panels and the second pair of linear guides and inserting the spreading frame between the first pair of linear guides.

2. The method of claim 1, further comprising at least one of:

fixing the linear guides at the edges of the shoring panels;

mounting the linear guides to supports and fixing a shoring panel on each side of the trench between two successive supports; and inserting a second pair of supports, to which the second pair of linear guides is mounted, between a first pair of supports at which a first pair of linear guides is arranged.

3. The method of claim 1, wherein a stiff spreading frame is used as the spreading frame between the second pair of linear guides.

4. The method of claim 3, further comprising at least one of:

spreading the spreading frame between the second pair of linear guides after insertion of a second shoring device into a first shoring device, under high pressure;

pressuring a hydraulic spreading device for spreading the spreading frame of the second shoring device;

after the spreading operation, using a locking element to arrest the spreading frame between the second pair of linear guides in the spread position; and inserting a locking plate between and screwed to two connecting flanges of the spreading frame.

5. The method of claim 3, further comprising at least one of:

the supports with the first pair of linear guides at the mutually oppositely insides have guide passages in which guide elements at the outsides of the spreading frame are displaceably accommodated in positively locking relationship and that the supports with the second pair of linear guides at their outsides have guide elements guided displaceably in the guide passages forming the first pair of linear guides;

the supports in succession along a trench wall with the first linear guides have mutually opposite receiving passages in which the edges of the shoring panels are displaceably guided; and an outer and upper shoring panel and an inner and lower shoring panel are displaceably guided in the mutually oppositely receiving passages of two successive supports with the first linear guides.

6. The method of claim 1, wherein the second pair of linear guides is inserted from above between the first pair of linear guides.

7. The method of claim 1, wherein the spreading frame between the first pair of linear guides is displaced prior to removal into a lower region of the first pair of linear guides.

8. The method of claim 7, further comprising at least one of:

the linear guides of the first pair co-operate in positively locking relationship with guide elements at the outsides of the spreading frame and after displacement of the spreading frame into the lower region of the linear guide the positively locking engagement with the guide elements is released;

the linear guides are guide passages in which guide elements arranged at the outsides of the spreading frame are displaceably accommodated in positively locking relationship and that the guide elements are removed from the guide passages through at least one opening in the lower region of the guide passages;

the spreading frame between the first pair of linear guides is drawn together inwardly for removal of its guide elements from the guide passages;

arranged at at least one outside of the spreading frame is at least one movable guide element which prior to removal of the spreading frame is moved from a first position within the linear guide into a second position outside the linear guide; and the movable guide element is moved in the first position within the linear guide from a first configuration in which the movable guide element engages behind portions of the linear guide to form the positively locking engagement into a second configuration in which there is no positively locking engagement.

9. The method of claim 1, further comprising at least one of:

releasing at least one screw connection prior to removal of the spreading frame between the first pair of linear guides; and upon removal of the spreading frame from between the first pair of linear guides, releasing and removing a spreading element of the spreading frame and then the further elements of the spreading frame are removed inwardly of the trench.

10. The method of claim 1, further comprising at least one of:

the supports in succession along a trench wall with the second linear guides have mutually opposite receiving passages in which the shoring panels are displaceably guided; and an outer and upper shoring panel and an inner and lower shoring panel are displaceably guided in the mutually oppositely receiving passages of two successive supports with the second linear guides.

11. The method of claim 1, wherein, in the lowering movement of a linear guide of the second pair of linear guides, a pressing device is fixed to the adjoining linear guide of the first pair of linear guides and presses against the upper end of the linear guide of the second pair of linear guides.

12. The method of claim 11, further comprising at least one of:

the pressing device is moved by the boom of an excavator into the region at the upper end of the linear guide of the second pair of linear guides;

the pressing device has a coupling portion of a quick-change coupling, for co-operating with a complementary coupling portion of the quick-change coupling on the boom of the excavator, wherein the pressing device is fixed to the boom by coupling of the two coupling portions;

first holding elements arranged at regular spacings at the linear guide of the first pair of linear guides, the first holding elements co-operating with second holding elements on the pressing device for fixing the pressing device to the adjoining linear guide of the first pair of linear guides;

the first holding elements are apertures and the second holding elements are projections inserted into the apertures; and at two opposite sides the pressing device respectively has at least one holding element and a pressing piston, wherein the pressing piston at the first side presses against the upper end of the second linear guide on the left-hand side of the trench and the pressing piston at the second side presses against the upper end of the second linear guide of the second pair thereof on the right-hand side of the trench.

13. A trench shoring device, comprising:

at least a first pair of mutually oppositely arranged shoring panels;

a first pair of linear guides;

at least a second pair of mutually oppositely arranged shoring panels suitable for being guided between the first pair of shoring panels and for being inserted into a trench;

a second pair of linear guides suitable for being inserted between the first pair of linear guides, wherein a respective linear guide of the second pair of linear guides is connected to a respective one of the shoring panels of the second pair of shoring panels;

at least a spreading frame suitable for being guided displaceably between one of the pairs of linear guides and holding the pair of linear guides at a spacing;

a spreading device with which the spacing between the outsides of the spreading frame is variable; and a locking element suitable for arresting the spreading frame in a spread position, wherein the trench shorting device further comprises at least one of:

the spreading device includes a hydraulic pressure cylinder;

the spreading frame has two connecting flanges, the spacing of which is variable using the spreading device and between which a locking plate of selectable thickness is fixable; and the hydraulic pressure cylinder is arranged in the region of a frame member of the spreading frame.

14. A spreading frame for a trench shoring device suitable for being guided displaceably between a pair of linear guides of the trench shoring device and holding the pair of linear guides at a spacing, the spreading frame comprising:

a spreading device for varying the spacing between the outsides of the spreading frame; and a locking element for arresting the spreading frame in a spread position, wherein the spreading frame further comprises: at least one of:

the spreading device includes a hydraulic pressure cylinder;

the spreading frame has two connecting flanges, the spacing of which is variable by means of the spreading device and between which a locking plate of selectable thickness is fixable; and the hydraulic pressure cylinder is arranged in the region of a frame member of the spreading frame.

15. The spreading frame of claim 14, wherein the spreading device is a hydraulic spreading device.

* * * * *